US010912393B2

(12) United States Patent
Piraino

(10) Patent No.: US 10,912,393 B2
(45) Date of Patent: Feb. 9, 2021

(54) METHOD AND SYSTEM FOR FORMING A SUPPORT STRUCTURE SUCH AS A BED OR CHAIR FOR A USER ACCORDING TO THE USER'S REQUIREMENTS

(71) Applicant: Mario Cladinoro Piraino, Doncaster East (AU)

(72) Inventor: Mario Cladinoro Piraino, Doncaster East (AU)

( * ) Notice: Subject to any disclaimer, the term of this patent is extended or adjusted under 35 U.S.C. 154(b) by 294 days.

(21) Appl. No.: 15/539,918

(22) PCT Filed: Dec. 24, 2015

(86) PCT No.: PCT/AU2015/000767

§ 371 (c)(1),
(2) Date: Jun. 26, 2017

(87) PCT Pub. No.: WO2016/101015

PCT Pub. Date: Jun. 30, 2016

(65) Prior Publication Data

US 2017/0340134 A1 Nov. 30, 2017

(30) Foreign Application Priority Data

Dec. 24, 2014 (AU) ..... 2014905272

(51) Int. Cl.
*A47C 31/12* (2006.01)
*A47C 27/14* (2006.01)
(Continued)

(52) U.S. Cl.
CPC ..... *A47C 31/123* (2013.01); *A47C 23/00* (2013.01); *A47C 27/04* (2013.01); *A47C 27/08* (2013.01);
(Continued)

(58) Field of Classification Search
CPC ..... A47C 31/123; A47C 31/126; A47C 27/04; A47C 27/083; A47C 27/085; A47C 27/14; A61G 7/05715
See application file for complete search history.

(56) References Cited

U.S. PATENT DOCUMENTS 4,586,493 A * 5/1986 Goodman ..... A61H 1/00 601/116
5,740,574 A * 4/1998 Piraino ..... A47C 27/001 5/716

(Continued)

FOREIGN PATENT DOCUMENTS

AU 2006222692 B2 10/2006
WO 2010/012333 A1 2/2010
WO 2012/176159 A1 12/2012

OTHER PUBLICATIONS

Australian Office Action for Australian Patent Application No. 2017208220 dated Jul. 17, 2018, 10 pages.

*Primary Examiner* — Robert G Santos
*Assistant Examiner* — Rahib T Zaman
(74) *Attorney, Agent, or Firm* — Klintworth & Rozenblat IP LLP; Eric D. Cohen

(57) ABSTRACT

An improved bed and method of forming with the required profile and localised support for a user by the improved bed at various sections of the bed including shoulder (A), lumbar (B) hip and lower body (C) such as by the mattress (15) having selected forms or voids a Shoulder Pressure Attenuation Area (SPAAM) a Lumbar Pressure Attenuation Area (LPAAM) a Hip Pressure Attenuation Area (HPAAM) and the base (26) having a Shoulder Pressure Attenuation Area (SPAAB) a Lumbar Pressure Attenuation Area (LPAAB) a Hip Pressure Attenuation Area (HPAAB) locatable at different locations along the longitudinal extension of the bed (32,42,52) with a Shoulder Pressure variation means (31) a Lumbar Pressure variation means (41) and a Hip Pressure variation means (51) comprising adjustable slats driven by electric motors.

17 Claims, 16 Drawing Sheets

(51) Int. Cl.

| | |
|---|---|
| ***A47C 27/04*** | (2006.01) |
| ***A61G 7/057*** | (2006.01) |
| ***A47C 23/00*** | (2006.01) |
| ***A47C 27/08*** | (2006.01) |

(52) U.S. Cl.
CPC ..... *A47C 27/083* (2013.01); *A47C 27/085* (2013.01); *A47C 27/14* (2013.01); *A47C 31/126* (2013.01); *A61G 7/057* (2013.01); *A61G 7/05715* (2013.01)

(56) References Cited

U.S. PATENT DOCUMENTS

| | | | | |
|---|---|---|---|---|
| 5,873,137 | A * | 2/1999 | Yavets-Chen | A61G 7/05776 5/188 |
| 7,712,172 | B2 * | 5/2010 | Jones | A61H 7/007 5/694 |
| 2003/0221262 | A1 * | 12/2003 | Torbet | A47C 27/082 5/713 |
| 2004/0010855 | A1 * | 1/2004 | Piraino | A47C 27/05 5/727 |
| 2007/0239370 | A1 * | 10/2007 | Block | A47C 23/002 702/41 |
| 2015/0351982 | A1 * | 12/2015 | Krenik | A47C 23/06 5/616 |

* cited by examiner

METHOD AND SYSTEM FOR FORMING A SUPPORT STRUCTURE SUCH AS A BED OR CHAIR FOR A USER ACCORDING TO THE USER'S REQUIREMENTS

FIELD OF THE INVENTION

The present invention relates to an improved bed or adjustable support structure/chair and method and system for forming an Improved Bed or adjustable support structure/chair.

In particular the present invention relates to an improved bed or adjustable support structure/chair having particular pressure attenuation areas and relative locations of pressure attenuation areas.

The invention has been developed primarily for use in an adjustable improved zone support bed or adjustable support structure/chair with manual, cam driven or automatic zone adjustments and will be described hereinafter with reference to this application. However, it will be appreciated that the invention is not limited to such adjustments but also includes variation of material adjustment and will be described with regard to each of these particular fields of use.

BACKGROUND OF THE INVENTION

A bed or adjustable support structure/chair is an important part of a user's well-being as they spend up to a third of their life in bed. A bed ensemble is a combination of an upper mattress supported on a lower base and forms a typical bedding apparatus in common use as shown in FIG. 1. Similarly, a support structure such as a chair usually includes an under structure with comfort cushions.

The upper mattress 15, can be of any type, composition or configuration to provide the necessary comfort and primary or secondary support for the user. The base 16 supported on legs 17 are the foundation used to elevate the mattress off the ground and to provide ventilation, but importantly to also provide conrolled support for the upper mattress or comfort cushions.

Macro support is important to give the mattress the correct and optimal overall support to suit the user's physique and orthopaedic requirements. The fine tuning or micro support of a bed has been generally confined to the upper mattress or comfort cushions which can be supplied in a range of hardness to suit the user. In addition, the upper mattress or comfort cushions can be tailored to suit individual requirements with the provision of hybrid components to suit dual occupancy. The correct and careful selection and adjustment of both the macro and micro support of a mattress or comfort cushions is vital to achieve the optimal bedding or chair support to suit the variety of user requirements, which vary with the different physical and medical requirements of each individual.

To date, the ability of a bed base to provide adequate macro support has been limited by the crude systems available. Currently available base systems include innerspring bases and platform bases using transverse slats.

For beds, while innerspring bases give the user an impression of "comfort" by feeling soft, this system provides minimal controlled macro support and results in a "bouncy feel" rather than adequate overall support for an upper mattress.

Platform bases and under structures also provide macro support but have limited adjustment potential even with the incorporation of double slats and firmness adjusters which allow individual slats to be adjusted to provide various degrees of flex over the length of the slat. Such systems do little to provide the upper mattress with the necessary macro support to give the user's body optimal orthopaedic support.

Double slats may provide variable flex giving rise to differential support but such slats only allow a deflection difference of up to about 15 mm over a standard slat when under load. Adult human bodies may have shape differences between the shoulders and waist of up to perhaps 80 mm. Accordingly, the potential deflection compensation available from double slats is quite insufficient to cater for such variations in the end user. Furthermore, double slats do not provide an individual height adjustment for the slats but only an individual flex adjustment.

Also the support of various parts of the body requires differing mechanisms. Generally to date variations of the same mechanisms are used for support of differing parts of the body. These have severe limitations when some body parts protrude, others recede, some parts are weightier or denser than others and some parts are more delicate or next to spinal portions that can be readily affected if not supported appropriately. It is therefore important to find other support mechanisms.

However another prime disadvantage of beds and other support structures such as chairs to date is that the person must adapt to the bed or other support rather than the bed adapt to the person. Although the beds or other support might have adjustment means they are at predefined positions and the person must use the bed or other support with the alterations at the restriction of the location on the bed or other support. It is important and particularly when beds are shared that there is flexibility of location of support means.

It is not sufficient that beds for example are merely multi-adjustable as that does not give the required support. Support is not merely allowing for deflection at the required position to allow the differing shaped profile of a person when standing as that is not the profile when lying. This is because of the differing weight at differing lying positions. Therefore a single density material will give differently along the length of the person lying on it. This gives a different pressure support along the body. Therefore at greatest displacement and greatest deflection at the hips the support will feel "hardest" and therefore hip soreness will occur.

Further there is different support or pressure requirements at different locations. A person has a body mass index (BMI), which is a measure of body fat based on height and weight that applies to adult men and women. A person with BMI might have padding at particular locations and require more deflection but less padding by the bed. Another person might have low BMI and therefore readily has soreness at protruding bones and needs more padding and lower pressure. Another person could have medical conditions such as osteoarthritis and require reduced pressure. Others who spend a lot of time in bed might require different contact support to avoid or decrease "bed sores".

It is stated by previous bed makers that their bed gives to the support of the person and matches the shape of the person to give support along the entire body. However these prior claims are not correct. In fact the beds are usually formed of a single material which gives as the contours of the silhouette of the person deflects the bed material. However that deflection causes compression of the material. The result is that the maximum deflection gives the maximum compression. Compression of a material does not relate to its resilience or support. Instead in single material beds it primarily relates to the hardness feel experienced at that location and not the support at that position. Further if a major deflection occurs at one location such as the hips but less deflection occurs at the waist then the give by the single material can have the hips with less deflection. However the give of these prior art beds are merely due to the deflection and not the required support. So the resulting angle of the lowered hips to the raised waist might be at an angle that is not suitable for comfortable support. It is clear these prior art beds to not provide a correct support by consideration of deflection and required weight support and required relative support of adjacent sections.

It can be seen that there are a number of problems of the prior art including one or more of:

a) Not allowing for different relative locations of essential positions along a user profile such as shoulders, lumbar and hips;

b) Not allowing for different deflections along the profile of the user;

c) Not allowing for different weight along the profile of the user;

d) Not allowing for different pressure support needed at different locations along the profile of the user;

e) Not facilitating the interrelationship of the support required at different locations along the profile of the user;

f) Not facilitating matching of the bed along the longitudinal length of the bed according to the required needs of the user along the profile of the user.

It is therefore an object of the invention to provide an improved method and system of forming an improved support mattress or support comfort cushions for chairs and an improved mattress support base or under structure system for a bed or support structure such as chair that allows better specific support for a range of users of beds and supports such as chairs.

It is also an object of the invention to provide an improved support mattress and base system for a support structures such as a bed that overcomes or at least ameliorates the problems of the beds and support structures such as chairs of the prior art.

The present invention seeks to provide an improved bed, or adjustable support structure which will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to the present invention, there is provided a method of forming an adjustable support structure to match a user including the steps of a) Determining a plurality of essential positions along the profile of the user;

b) Determining required support needs at the essential positions of the profile of the user; and c) Forming a support structure with differing support characteristics along the length of the support structure wherein the matching of the support structure to the user matches the required support needs of the user at the essential positions of the profile of the user.

Preferably the differing support characteristics matching required support needs includes one or more of:

a) Depression, being positive or negative depression, to allow varying width of portion of user body at essential positions along the profile of the user;

b) Support to support the portion of user body at essential positions along the profile of the user; and c) Pressure attenuation to vary the pressure on the width of portion of user body at essential positions along the profile of the user to match:

i) The weight at the width of portion of user body at essential positions along the profile of the user; or ii) The cushioning contact need at the width of portion of user body at essential positions along the profile of the user The essential positions of the profile of the user can include at least one or more of Shoulder area, Lumbar area and Hip area.

The forming of the support structure with differing support characteristics along the length of the support structure can include the steps of:

a) Using the measured essential positions along the profile of the user, create corresponding essential positions along the length of a support structure matching the longitudinal spacing along the profile of the user;

b) Using the detected required support needs at the essential positions and creating the support structure at the corresponding positions matching along the user profile;

c) Completing the formation of the support structure along its length.

In another form the method of forming a support structure to match a user can include the step of pre-forming of the bed with differing support characteristics along the length of the support structure includes the steps of:

a) Providing a general structure of a bed having a plurality of essential positions along the support structure;

b) Using the measured essential positions along the profile of the user, moving longitudinally corresponding essential positions along the length of a support structure to match the longitudinal spacing along the profile of the user; and c) Using the detected required support needs at the essential positions modifying the plurality of essential positions to match the required support at the corresponding positions matching along the user profile.

The step of completing the formation of the support structure along its length might require modifying the further support to rematch the required support needs at the corresponding positions matching along the user profile.

The method of forming a support structure preferably the essential positions of the profile of the user includes at least the plurality of Shoulder area, Lumbar area and Hip area.

The weight support at each essential position can be formed to give support proportional to P/D where P is weight and D is depression.

Ks, Kw, Kh, can be 'inter-related' as per the equations $Kw=Pw/Dw$, $Kh=Ph/Dh=Ph/I+H$ and $Ks=Ps/Ds=Ps/I+L+S$ wherein I is Indentation into mattress; H is Hip protrusion past waist; and S is Shoulder protrusion past hip.

An improved bed can be formed by the above method that includes a shoulder pressure attenuation area in order to improve the posture of the user of the bed.

Throughout the description and claims the term support structure is understood to mean a bed or a chair having a base or under-structure and a mattress or comfort cushions in the case of a chair.

According to another aspect of the present invention, there is provided a method of forming a bed or adjustable support structure to match a user wherein the bed or adjustable support structure comprises:

one or more pressure variation blocks being located at the essential positions of the profile of a user; and a plurality of supports receivable by the one or more pressure variation blocks, wherein the step of forming the bed or adjustable support structure comprises varying the vertical profile of one or more of the plurality of supports by the one or more pressure variation blocks according to essential positions of the profile of the user.

In a related aspect of the present invention, there is provided a method of forming a bed to match a user wherein the bed further comprises a location variation system adapted to move the one or more pressure variation blocks in a longitudinal direction of the bed, and wherein in forming the bed the one or more plurality of supports and the one or more pressure variation blocks is adjusted vertically and longitudinally of the bed separately or together to provide required support needs to suit a user's profile.

According to another aspect of the present invention, there is provided an improved support structure which includes a plurality of supports locatable at a plurality of pressure attenuation area including one providing a shoulder pressure attenuation in order to improve the posture of the user of the support structure.

Preferably one of the plurality of supports locatable at a plurality of pressure attenuation area is a lumbar pressure attenuation area.

Preferably one of the plurality of supports locatable at a plurality of pressure attenuation area is a hip pressure attenuation area.

Preferably the improved bed is provided by inclusion of a shoulder pressure recess in order to allow receipt of the breadth of the user at the shoulder position to improve the posture of the user of the bed.

According to a third aspect of the present invention, an improved support structure is provided wherein at least one of the plurality of supports locatable at a plurality of pressure attenuation area is adjustable along the length of the support structure.

Preferably at least one of the plurality of supports locatable at a plurality of pressure attenuation area is adjustable in a direction substantially orthogonal to the plane of the top surface of the support structure.

The pressure attenuation area can be in the mattress portion of a base and mattress bed.

The pressure attenuation area can be in the base portion of a base and mattress bed.

The pressure attenuation area is in both the base portion and the mattress portion of a base and mattress bed.

Preferably the inclusion of a shoulder pressure variation is in a direction to the vertical at a shoulder receiving portion and a variation of the location of the shoulder receiving portion along the support structure to suit different users.

In accordance with the invention there is provided an improved bed comprising a shoulder support locatable at a shoulder pressure attenuation area providing a shoulder pressure attenuation in order to improve the posture of the user of the bed.

Preferably the shoulder pressure attenuation area is in the mattress portion of a base and mattress bed.

Preferably the shoulder pressure attenuation area is in the base portion of a base and mattress bed.

However more preferably the shoulder pressure attenuation area is in both the base portion and the mattress portion of a base and mattress bed.

The shoulder pressure attenuation area is a lower density material to the other bed support parts of the mattress portion of a base and mattress bed. The shoulder pressure attenuation area can be a lower resiliency material or structure to the other bed support parts of the mattress portion of a base and mattress bed.

Preferably the shoulder pressure attenuation area has a movable support that can be altered in vertical direction to provide a variation in height of the shoulder pressure attenuation area of the mattress relative to the support of other bed support parts of the mattress portion of a base and mattress bed.

The shoulder pressure attenuation area can comprise a shoulder pressure recess in order to allow receipt of the breadth of the user at the shoulder position to improve the posture of the user of the bed.

Preferably there is provided a shoulder pressure variation location means for providing a variation of the location of the shoulder receiving portion along the bed to suit different users.

The shoulder pressure variation can be in a direction to the vertical at a shoulder receiving portion and a variation of the location of the shoulder receiving portion along the bed to suit different users.

The invention can also provide an improved bed comprising a lumbar support locatable at a lumbar pressure attenuation area providing a lumbar pressure attenuation in order to improve the posture of the user of the bed.

Preferably the lumbar pressure attenuation area is in the mattress portion of a base and mattress bed.

However the lumbar pressure attenuation area can be in the base portion of 20 a base and mattress bed.

Preferably the lumbar pressure attenuation area is in both the base portion and the mattress portion of a base and mattress bed.

The invention can also provide an improved bed comprising a hip support locatable at a hip pressure attenuation area providing a hip pressure attenuation in order to improve the posture of the user of the bed.

Preferably the hip pressure attenuation area is in the mattress portion of a base and mattress bed.

However the hip pressure attenuation area can be in the base portion of a base and mattress bed.

Preferably the hip pressure attenuation area is in both the base portion and the mattress portion of a base and mattress bed.

The lumbar pressure attenuation area and the hip pressure attenuation area can be a higher density material to the other bed support parts of the mattress portion of a base and mattress bed. This can be by having the lumbar pressure attenuation area and the hip pressure attenuation area of a higher or lower resiliency material or structure relative to adjacent other bed support parts of the mattress portion of a base or the mattress bed or the combination of base and mattress.

Preferably the shoulder pressure attenuation area has a movable support that can be altered in vertical direction to provide a variation in height of the shoulder pressure attenuation area of the mattress relative to the support of other bed support parts of the mattress portion of a base and mattress bed.

Preferably the support includes a lumbar pressure mound in order to allow receipt of the breadth of the user at the lumbar position to improve the posture of the user of the bed.

An improved bed can further comprise a lumbar pressure variation location means for providing a variation of the location of the lumbar receiving portion along the bed to suit different users. The lumbar pressure variation can be in a direction to the vertical at a lumbar supporting portion and a variation of the location of the lumbar supporting portion along the bed to suit different users.

The invention can provide an improved bed providing the shoulder support locatable at the shoulder pressure attenuation area providing a shoulder pressure attenuation in order to improve the posture of the user of the bed wherein the shoulder pressure attenuation area is in the mattress portion of a base and mattress bed; wherein the shoulder support locatable at the shoulder pressure attenuation area is a shoulder pressure recess or void in order to allow receipt of the breadth of the user at the shoulder position to improve the posture of the user of the bed.

The mattress can have a head portion and a body portion joined together but allowing the shoulder pressure recess or void. Preferably the mattress has a head portion and a body portion which are joined peripherally. Preferably the mattress has a head portion and a body portion which are joined peripherally along an underside. Preferably the mattress has a head portion and a body portion joined together by a loose top surface allowing the shoulder of the user to be able to be received in the shoulder pressure recess or void.

The mattress can have a head portion and a body portion joined together with adjacent movable blocks allowing for variable location of the shoulder pressure recess or void along the longitudinal length of the bed.

The invention also provides an improved bed for improving the posture of the user of the bed comprising:

a) a bed support of one or more parts extending substantially coplanar for supporting the user;

b) a shoulder pressure attenuation area in order to allow receipt of the breadth of the user at the shoulder position of the user to improve the posture of the user of the bed;

c) a shoulder pressure variation means of shoulder pressure attenuation area to adjust the relative vertical position relative to the bed support at the shoulder receiving portion d) and a location variation means of the shoulder receiving portion for relatively adjusting the location of the shoulder pressure attenuation area in a direction along the bed to suit different users;

wherein the one or more parts of the bed support and the shoulder pressure variation means support the user of the bed in an improved posture.

An improved bed can comprise a) a shoulder support locatable at a shoulder pressure attenuation area providing a shoulder pressure attenuation in order to improve the posture of the user of the bed, i) wherein portions of the shoulder support are located in shoulder pressure attenuation areas in the mattress of a bed and/or in a base of the bed ii) and wherein the shoulder pressure attenuation area in both the base and the mattress of the bed being separately alignable to each other and separately including shoulder supports but coordinating to provide a combined shoulder pressure attenuation area;

b) a shoulder pressure variation location means for providing a variation along the bed to suit different users of the location of the shoulder pressure attenuation area in the mattress or the base of the bed i) wherein parts of a shoulder pressure variation location means are located in the base and/or the mattress of the base and mattress of the bed ii) and wherein the mattress shoulder pressure variation location means and the base shoulder pressure variation location means being separately movable longitudinally along the bed relative to each other but coordinating to provide location of the combined shoulder pressure attenuation area to suit different users.

Preferably the shoulder pressure attenuation area is a lower density material to the other bed support parts of the mattress portion of a base and mattress bed. The shoulder pressure attenuation area can be a lower resiliency material or structure to the other bed support parts of the mattress portion of a base and mattress bed. The shoulder pressure attenuation area can have a movable support that can be altered in vertical direction to provide a variation in height of the shoulder pressure attenuation area of the mattress relative to the support of other bed support parts of the mattress portion of a base and mattress bed.

Preferably the improved bed further comprises a shoulder pressure recess in order to allow receipt of the breadth of the user at the shoulder position improve the posture of the user of the bed.

The improved bed can further include:

a) a lumbar support locatable at a lumbar pressure attenuation area providing a lumbar pressure attenuation in order to improve the posture of the user of the bed, i) wherein portions of the lumbar support are located in lumbar pressure attenuation areas in the mattress of a bed and/or in a base of the bed ii) and wherein the lumbar pressure attenuation area in both the base and the mattress of the bed being separately alignable to each other and separately including lumbar supports but coordinating to provide a combined lumbar pressure attenuation area;

b) a lumbar pressure variation location means for providing a variation along the bed to suit different users of the location of the lumbar pressure attenuation area in the mattress or the base of the bed i) wherein parts of a lumbar pressure variation location means are located 5 in the base and/or the mattress of the base and mattress of the bed ii) and wherein the mattress lumbar pressure variation location means and the base lumbar pressure variation location means being separately movable longitudinally along the bed relative to each other but coordinating to provide location of the combined lumbar pressure attenuation area to suit different users.

The improved bed can further include a) a hip support locatable at a hip pressure attenuation area providing a hip pressure attenuation in order to improve the posture of the user of the bed, i) wherein portions of the hip support are located in hip pressure attenuation areas in the mattress of a bed and/or in a base of the bed ii) and wherein the hip pressure attenuation area in both the base and the mattress of the bed being separately alignable to each other and separately including hip supports but coordinating to provide a combined hip pressure attenuation area;

b) a hip pressure variation location means for providing a variation along the bed to suit different users of the location of the hip pressure attenuation area in the mattress or the base of the bed i) wherein parts of a hip pressure variation location means are located in the base and/or the mattress of the base and mattress of the bed ii) and wherein the mattress hip pressure variation location means and the base hip pressure variation location means being separately movable longitudinally along the bed relative to each other but coordinating to provide location of the combined hip pressure attenuation area to suit different users.

It can be seen that the invention provides the benefit of an improved bed which includes a zoned support with a combination of one or more of the following features of a shoulder pressure attenuation area, a recess or void providing a shoulder pressure attenuation area, and a variation of the longitudinal location of the shoulder receiving portion along the bed to suit different users a lumbar pressure attenuation area, a recess or void or mound providing a lumbar pressure attenuation area; and a variation of the longitudinal location of the lumbar supporting portion along the bed to suit different users.

Other aspects of the invention are also disclosed including: an improved bed comprising one or a series of mattresses or an adjustable base including a shoulder support locatable at a shoulder pressure attenuation area providing a shoulder pressure attenuation in order to improve the posture of the user of the bed, wherein portions of the shoulder support are located in shoulder pressure attenuation areas in the mattress of a bed and/or in a base of the bed and wherein the shoulder pressure attenuation area in both the base and the mattress of the bed being separately alignable to each other and separately including shoulder supports but coordinating to provide a combined shoulder pressure attenuation area; a shoulder pressure variation location means for providing a variation along the bed to suit different users of the location of the shoulder pressure attenuation area in the mattress or the base of the bed wherein parts of a shoulder pressure variation location means are located in the base and/or the mattress of the base and mattress of the bed and wherein the mattress shoulder pressure variation location means and the base shoulder pressure variation location means being separately movable longitudinally along the bed relative to each other but coordinating to provide location of the combined shoulder pressure attenuation area to suit different users.

The shoulder pressure attenuation area can be a) a lower density material to the other bed support parts of the mattress portion of a base and mattress bed.

b) a lower resiliency material or structure to the other bed support parts of the mattress portion of a base and mattress bed.

c) a movable support that can be altered in vertical direction to provide a variation in height of the shoulder pressure attenuation area of the mattress relative to the 30 support of other bed support parts of the mattress portion of a base and mattress bed.

d) a shoulder pressure recess in order to allow receipt of the breadth of the user at the shoulder position improve the posture of the user of the bed.

e) a shoulder pressure variation in a direction to the vertical at a shoulder receiving portion and a variation of the location of the shoulder receiving portion along the bed to suit different users.

Further the shoulder pressure attenuation area can provide variation of the "shoulder area" in a localised area—from the top surface of the mattress, which is easily opened or the topmost layer of which is able to be lifted off, to produce the desired depression Ds in a direction to the vertical at a shoulder receiving portion and a variation of the location of the shoulder receiving portion along the bed to suit different users.

However the shoulder pressure attenuation area providing variation of the "shoulder area" in a localised area can be varied from the 'side wall of the mattress' to the desired depression Ds.

Still further the shoulder pressure attenuation area providing variation of the "shoulder area" in a localised area may vary from the side wall of the mattress to the desired depression Ds.

In a particular form of the improved bed there is further included a lumbar support locatable at a lumbar pressure attenuation area providing a lumbar pressure attenuation in order to improve the posture of the user of the bed, wherein portions of the lumbar support are located in lumbar pressure attenuation areas in the mattress of a bed and/or in a base of the bed and wherein the lumbar pressure attenuation area in both the base and the mattress of the bed being separately alignable to each other and separately including lumbar supports but coordinating to provide a combined lumbar pressure attenuation area; a lumbar pressure variation location means for providing a variation along the bed to suit different users of the location of the lumbar pressure attenuation area in the mattress or the base of the bed wherein parts of a lumbar pressure variation location means are located in the base and/or the mattress of the base and mattress of the bed and wherein the mattress lumbar pressure variation location means and the base lumbar pressure variation location means being separately movable longitudinally along the bed relative to each other but coordinating to provide location of the combined lumbar pressure attenuation area to suit different users.

Still in a further form the improved bed further includes a hip support locatable at a hip pressure attenuation area providing a hip pressure attenuation in order to improve the posture of the user of the bed, wherein portions of the hip support are located in lumbar pressure attenuation areas in the mattress of a bed and/or in a base of the bed and wherein the hip pressure attenuation area in both the base and the mattress of the bed being separately alignable to each other and separately including hip supports but coordinating to provide a combined hip pressure attenuation area; a lumbar pressure variation location means for providing a variation along the bed to suit different users of the location of the hip pressure attenuation area in the mattress or the base of the bed wherein parts of a hip pressure variation location means are located in the base and/or the mattress of the base and mattress of the bed and wherein the mattress hip pressure variation location means and the base hip pressure variation location means being separately movable longitudinally along the bed relative to each other but coordinating to provide location of the combined hip pressure attenuation area to suit different users.

The lumbar support locatable at a lumbar pressure attenuation area providing lumbar pressure attenuation in order to improve the posture of the user of the bed.

The lumbar pressure attenuation area can be in the mattress portion of a base and mattress bed.

The lumbar pressure attenuation area can be in the base portion of a base and mattress bed.

The lumbar pressure attenuation area can be in both the base portion and the mattress portion of a base and mattress bed.

The lumbar pressure attenuation area can be:

a) is a higher density material to the other bed support parts of the mattress portion of a base and mattress bed.

b) a higher resiliency material or structure to the other bed support parts of the mattress portion of a base and mattress bed.

c) a movable support that can be altered in vertical direction to provide a variation in height of the shoulder pressure attenuation area of the mattress relative to the support of other bed support parts of the mattress portion of a base and mattress bed.

d) a lumbar pressure mound in order to allow receipt of the breadth of the user at the lumbar position to improve the posture of the user of the bed.

e) a lumbar pressure variation location means for providing a variation of the location of the lumbar receiving portion along the bed to suit different users.

f) a lumbar pressure variation in a direction to the vertical at a lumbar supporting portion and a variation of the location of the lumbar supporting portion along the bed to suit different users.

In the case of a shoulder, waist and lumbar pressure attenuation areas, Ks, Kw, Kh, are 'inter-related' as per the equations:

$$Kw=Pw/Dw,\ Kh=Ph/Dh=Ph/I+H\ Ks=Ps/Ds=Ps/I+L+S$$

by relative adjustment of the firmness of the support materials (springs, foam, latex, gas bag, liquid bag, etc) but which vary within the mattress and within the limits set as:

| | | |
|---|---|---|
| Indentation to vary between | I | 1 mm and 40 mm |
| Hips to protrude past waist by | L | 1 mm to 70 mm |
| Shoulders to protrude past waist by | S | −30 mm (smaller width than waist) to 100 mm |

Indentation to vary between I 1 mm and 40 mm Hips to protrude past waist by L 1 mm to 70 mm Shoulders to protrude past waist by S −30 mm (smaller width than waist) to 100 mm The mattress or a series of mattresses further can further comprise the shoulder pressure attenuation area providing variation of the "shoulder area" in a localised area—by one or more of:

a) the "shoulder area" varied in a localised area—from the 'top surface of the mattress' (easily opened or the topmost layer of which is able to be lifted off) to produce the desired depression Ds b) the "shoulder area" varied from the 'top surface of the mattress' to produce the desired depression Ds and the Lumbar area varied from the 'side wall of the mattress' to the desired depression Dw c) the "shoulder area" varied from the 'top surface of the mattress' to produce the desired depression Ds, the Lumbar area may be varied from the 'side wall of the mattress' to the desired depression Dw and the Hip area may be varied from the 'side wall of the mattress' to the desired depression Dh.

The improved bed can have an adjustable base as in a fixed base or a multi-knuckle adjustable bed which includes one or more of:

i. a means of causing vertical displacement +ve or −ve under the shoulder area by raising or lowering the support member(s) either manually or by turning a rod/shaft which in turn turns some cams which lower or raise a supporting member—at that area, or using a motor or a series of levers ii. the mattress may also have a means of moving the means that causes vertical displacement horizontally towards the head or the feet of the user iii. The base has a means of causing vertical displacement +ve or −ve under the lumbar area by raising or lowering the support member(s) manually or by using motors (powered by electricity, magnetic field, pressure means, other) or a series of levers or by turning a rod/shaft which in turn turns some cams at that area iv. the base may also have a means of moving the 'means that causes vertical displacement' at the lumbar area horizontally towards the head or the feet of the user v. a base with a means of causing vertical displacement +ve or −ve under the hip area and a by raising or lowering the support member(s) either manually or by turning a rod/shaft which in turn turns some cams which lower or raise a supporting member—or by using motors or a series of levers at that area vi. a means of moving the 'means that causes vertical displacement' horizontally towards the head or the feet of the user vii. a further means of causing vertical displacement +ve or −ve under the any other area of the body by turning a rod/shaft which in turn turns some cams which lower or raise a supporting member—at that area viii. a means of moving these other 'means that causes vertical displacement' horizontally towards the head or the feet of the user;

ix. by turning a rod or shaft which in turn moves cams;

x. using a series of levers;

xi. using powered pistons, deflectors, linear actuators, xii. magnetic field deflectors, linear actuators xiii. differential material deflectors xiv. differential pressure deflectors, linear actuators.

In a related aspect of the invention there is disclosed an improved support structure such as a bed having a plurality of supports locatable at a plurality of pressure attenuation areas in each or all its planes to improve posture of a user and adjustability of the bed comprising:

a mattress and base support therefor;

a support system adjustably locatable at predetermined pressure attenuation areas of the mattress and base of the bed, wherein portions of the support system in the predetermined pressure attenuation areas of the base of the bed comprise a carriage movably mounted on a longitudinal track in the base, wherein the carriage is adapted to receive an adjustable platform or arms supporting one or more slats or layers at varying heights, and one or more drive means for moving the carriage along the track in a longitudinal direction and altering the height of the one or more support members separately or together by the platform or arms;

wherein the predetermined pressure attenuation areas of the base of the bed are separately adjustable in the predetermined pressure attenuation areas relative to the mattress to suit different users of the bed.

In a further related aspect of the invention there is disclosed an improved bed having a plurality of supports locatable at a plurality of pressure attenuation areas in each or all its planes to improve posture of a user and adjustability of the bed comprising:

a mattress and base support therefor;

a shoulder support system adjustably locatable at a shoulder pressure attenuation area, wherein portions of the shoulder support are located in shoulder pressure attenuation areas of the mattress and base of the bed;

wherein portions of the shoulder support system in the shoulder attenuation area of the base of the bed comprise:

a carriage movably mounted on a longitudinal track located in the base, wherein the carriage is adapted to receive an adjustable platform supporting one or more shoulder support members (slats or layers) at varying heights, and one or more drive means for moving the carriage along the track in a longitudinal direction and altering the height of the one or more shoulder support members separately or together by the platform;

wherein the shoulder attenuation area of the base of the bed is adjustable relative to the portions of the shoulder support located in shoulder pressure attenuation areas of the mattress to suit different users of the bed; and wherein both the base and the mattress of the bed being separately alignable to each other and separately comprising shoulder support members but coordinating to provide a combined shoulder pressure attenuation area, wherein both the base and the mattress of the bed being separately alignable to each other and separately including shoulder support members but coordinating to provide a combined shoulder pressure attenuation area.

In yet a further related aspect of the present invention there is disclosed an improved adjustable base/under-structure for a support structure such as a bed or chair comprising:

one or more pressure variation blocks being located at predetermined shoulder, waist and lumbar pressure attenuation areas providing a shoulder, waist and lumbar attenuation according to the profile of a user, the pressure variation blocks being linked together by knuckles at knuckle joints to form a chain, whereby a knuckle joint allows angular adjustment of one knuckle relative to its neighbour to alter the positioning of the pressure variation blocks and thereby configuration of the base/under-structure;

one or more movable supports mounted on the one or more pressure variation blocks;

a shoulder pressure variation location means for providing a variation of the one or more movable supports on the one or more pressure variation blocks in a direction to the vertical at a shoulder receiving portion;

a waist pressure variation location means for providing a variation of the one or more movable supports on the one or more pressure variation blocks in a direction to the vertical at a waist receiving portion;

a lumbar pressure variation location means for providing a variation of the one or more movable supports on the one or more pressure variation blocks in a direction to the vertical at a lumbar receiving portion;

wherein the one or more pressure variation blocks of the base/under-structure of the bed or chair are separately adjustable in the predetermined pressure attenuation areas relative to the mattress/cushions to suit different users of the support structure.

In this embodiment, the configuration of the base/under-structure can be suitably altered between a sitting position, a semi-reclined position, or a flat or prone position, to improve the posture of a user while in these range of base configurations.

The knuckles used to form the chain of pressure variation blocks in the base/under-structure can be of different lengths to accommodate pressure variation blocks of different sizes and to provide a range of different configurations.

The shoulder, waist and lumbar pressure variation location means can comprise a motor adapted to drive a lever or piston which in turn raises or lowers the one or more movable supports.

Alternatively, the pressure variation location means can comprise a pantograph arrangement located in the one or more pressure variation blocks, the pantograph being fixed at one end and movable between a folded and unfolded condition to urge against a movable support thereby to provide positive vertical displacement of the support and alter the configuration of the one or more pressure variation blocks at predetermined shoulder, waist and lumbar pressure attenuation areas.

In a further preferred embodiment, the pressure variation location means can comprise a sling mounted between rollers in the pressure variation blocks, whereby the rollers displace the sling between a substantially flat position relative to the base inwardly of the blocks to provide negative vertical displacement of the one or more movable supports.

It can be seen that the invention provides the benefit of an improved adjustable chair which includes a zoned support with a combination of one or more of the following features of a shoulder pressure attenuation area, a recess or void providing a shoulder pressure attenuation area, and a variation of the longitudinal location of the shoulder receiving portion along the bed to suit different users a lumbar pressure attenuation area, a recess or void or mound providing a lumbar pressure attenuation area; and a variation of the longitudinal location of the lumbar supporting portion along the bed to suit different users.

BRIEF DESCRIPTION OF THE DRAWINGS

Notwithstanding any other forms which may fall within the scope of the present invention, a preferred embodiment/preferred embodiments of the invention will now be described, by way of example only, with reference to the accompanying drawings in which:

a)

b)

c)

d)

e)

f) FIG. 7 is the required profile of support for a user by the improved bed at various sections of the bed including shoulder (A), lumbar (B) and lower body (C);

g)

h)

i)

j)

k)

l)

m)

n)

o)

DESCRIPTION OF PREFERRED EMBODIMENTS

Figure 1:
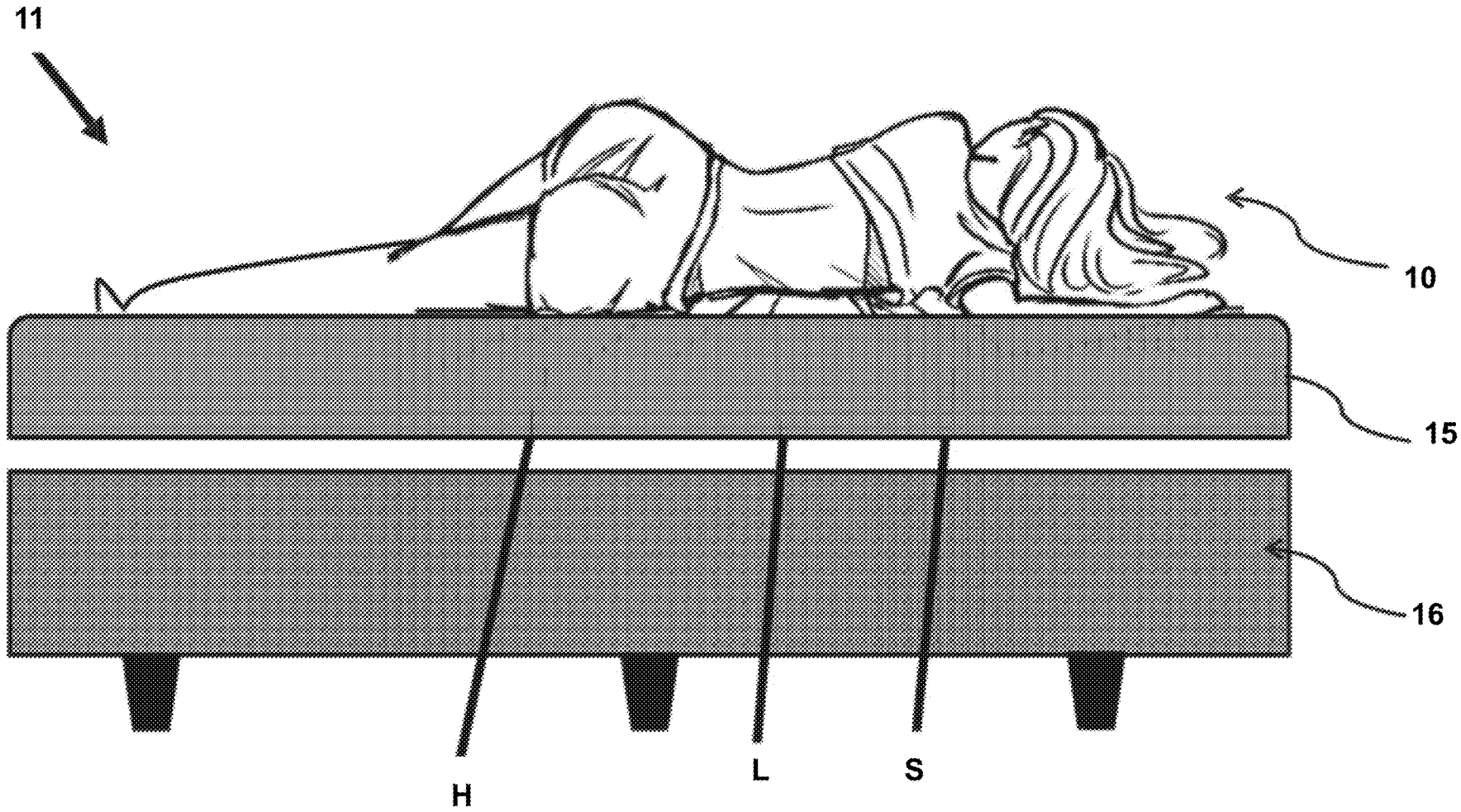
FIG. 1 is a diagrammatic view of a user on a bed.
Figure 2:
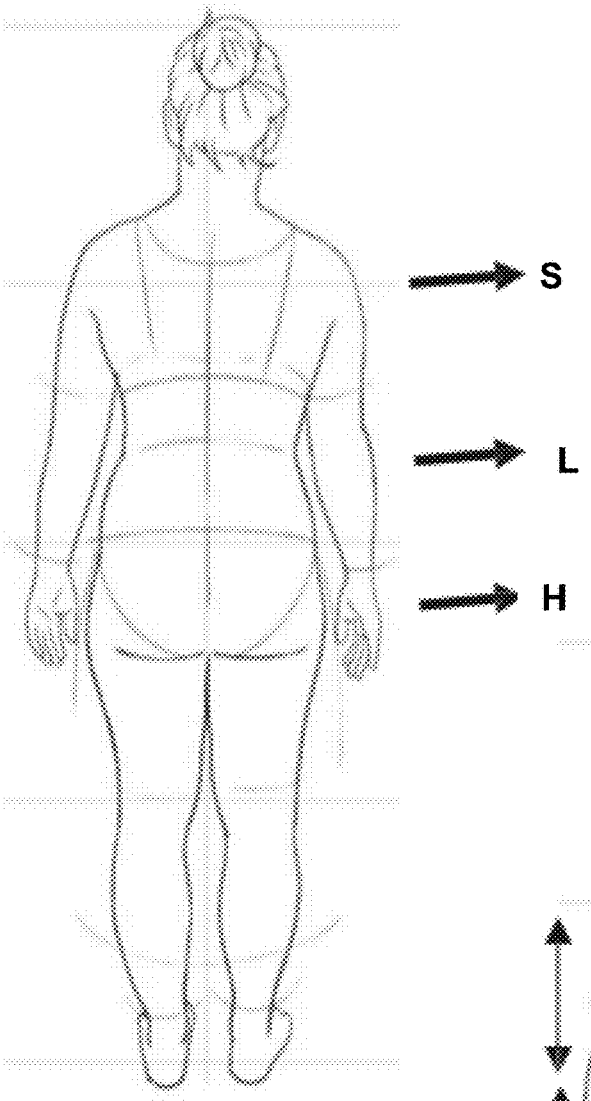
FIGS. 2 and 3 are diagrammatic views of locations of essential positions on profile of user and relative widths, spacing and weight at these locations.
Figure 3:
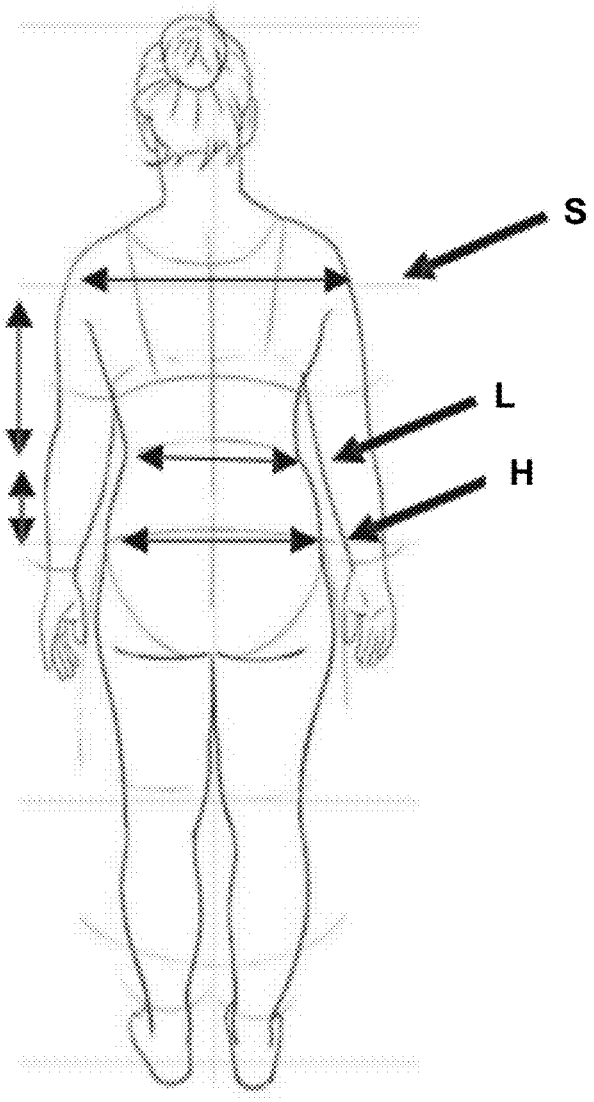

It should be noted in the following description that like or the same reference 10 numerals in different embodiments denote the same or similar features.

a) General Structure Requirements

Referring to the drawings and particularly FIGS. 1 to 3 and 7 there is shown 15 an improved bed with the required profile of support for a user by the improved bed at various sections of the bed including shoulder (A), lumbar (B) hip and lower body (C).

In order to provide a further level of macro adjustment, height adjustment of individual slats in a platform base would provide clear advantages. Whilst some prior art devices are known which provide slating adjustment for bed bases incorporating individual transverse slats, none of the known prior art devices provide a ready means of adjusting individual slats in a quantitative and calibrated manner so as to allow the user or a medical adviser a satisfactory means of making suitable adjustment to confidently meet an individual's particular requirements.

If such individual height adjustment could be provided and could be operated 25 external to the bed base, a means of ready and convenient alteration of a bed's macro support would be achieved.

Since people have unique body shapes and weight distribution along the length of their bodies, mattress and bed ensembles need some means of variable support along the length of the mattress. In particular the adjustment is required from the shoulder down to the waist, lower back, hip, under the knees and ultimately at the lower leg and feet.

Of prime importance is the correct support of a person in a bed, particularly if a person is in bed for a long period such as in the case of incapacitated people or 21 patients in hospitals. It is well recognized throughout the health fraternity that 'a person's bed plays a significant part in the person's health and well-being'. Health experts tell us that for the human body to rest well, it needs to be supported in its natural shape. This natural/neutral posture imposes the least amount of stress on 5 muscles, joints and the spinal/vertebral column. The user can get distortion from this position, as stresses can occur in muscles, nerves, joints and wedging can occur in the 10 spinal disks.

b) Requirements of the User

A principal object of a bed mattress is to provide optimal support for the user commensurate with their physical and medical requirements. Such optimal support requires the mattress to conform substantially to the shape of the user's body when resting on the mattress. Unfortunately, most available mattresses react proportionally to the weight distribution of the user's body, compressing most where the body is heaviest and least where the body is lightest. This results in mattress conformation which does not reflect the actual physical shape of the user's body, but rather reflects a shape imposed on the mattress by the weight distribution of the body. Accordingly, the user's body adopts a shape, which results from the weight distribution of body segments, which does not reflect the actual body shape when resting on a standard mattress. The user's skeleton is then twisted and distorted to fit the shape of the mattress as it has reacted to the user's weight distribution.

The areas of greatest distortion are the shoulder and lumbar/hip regions. The shoulders are usually the widest part of the human body but occur at the lightest region of the torso. Accordingly the shoulders, when a user is resting on their side, do not push a mattress down much in accordance with the body shape resulting in a degree of twisting of the body when the user is sleeping on their side. In contrast to the shoulder and upper torso region, the hips and lumbar region of the torso are generally much heavier and this region of the user's body will compress that part of a mattress disproportionately. In standard mattresses of uniform stiffness this results in the pelvis region being the lowest supported part of the body.

Furthermore, the close proximity of the hip region to the waist region of the user tends to deprive the waist, and important lumbar region, of the user with adequate support as the mattress is highly compressed at the hip region and the adjoining area of the mattress leading into the lumbar region is also compressed where it should actually be providing support.

c) Designing of the Bed.

Figure 4:
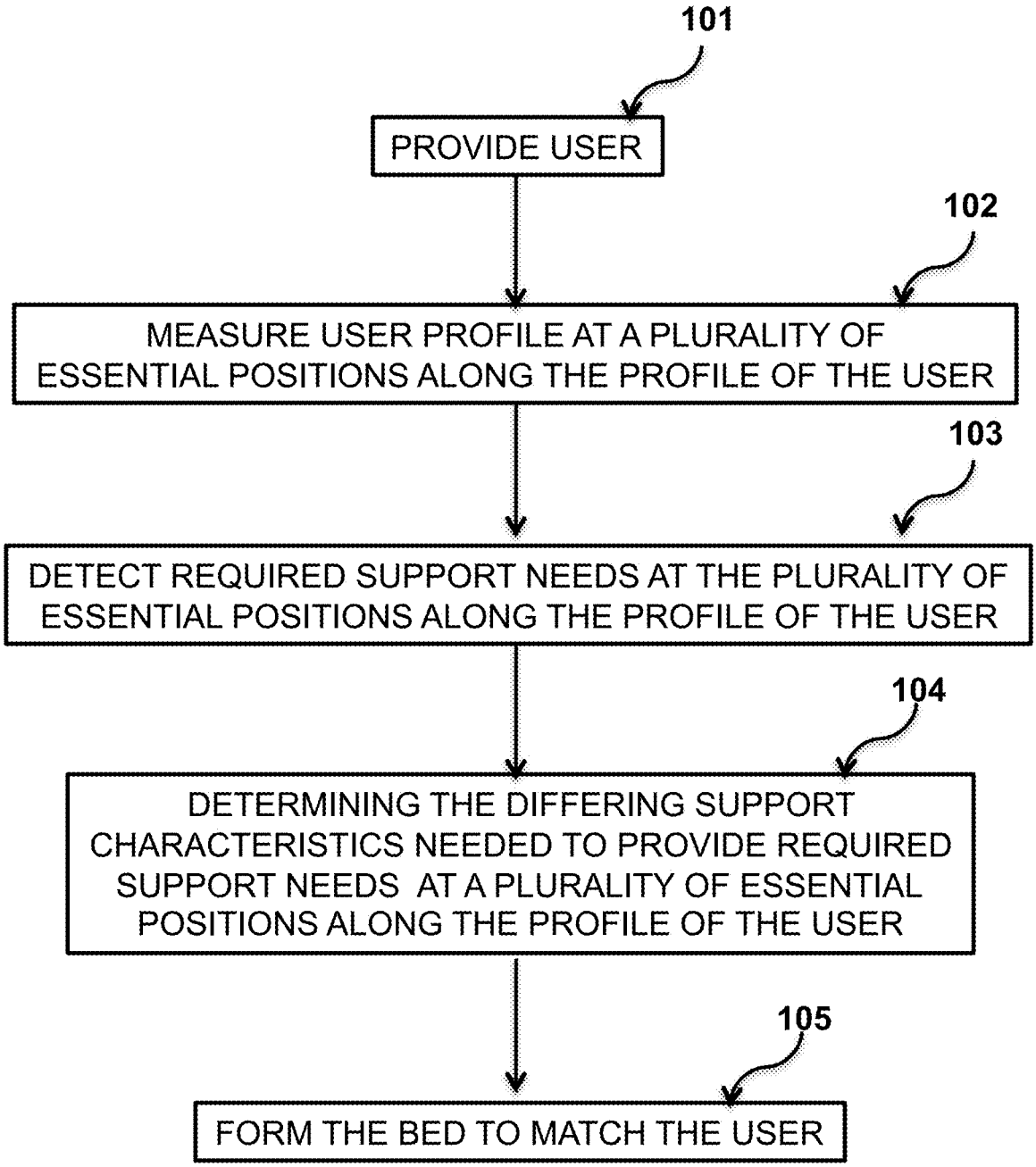
FIG. 4 is a diagrammatic flow diagram of the steps of method of forming a bed to match a user in accordance with a preferred embodiment of the present invention.
Figure 5:
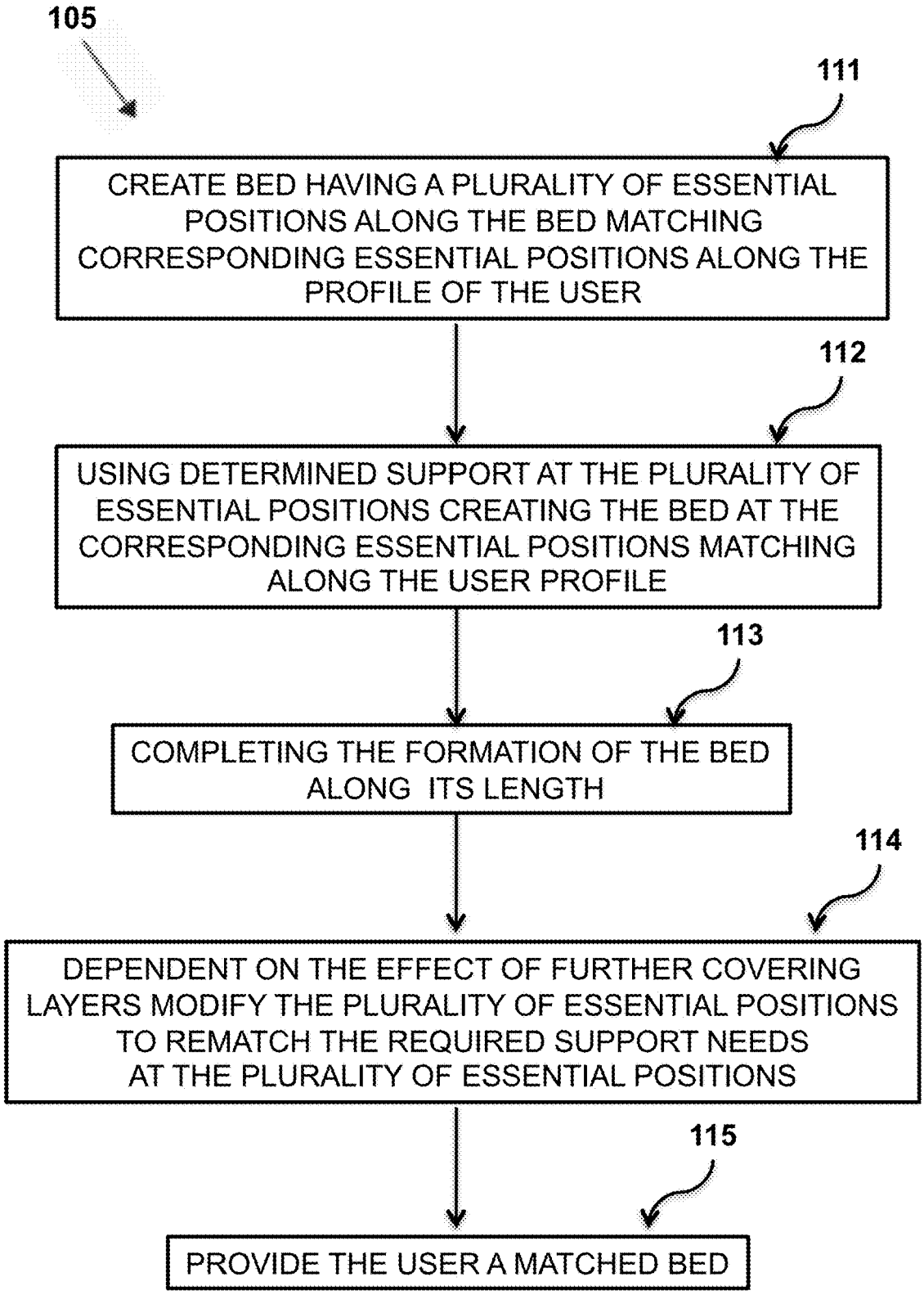
FIG. 5 is a diagrammatic flow diagram of the steps of forming the bed directly from the determined characteristics of the user in accordance with a preferred embodiment of the present invention.

Referring to FIGS. 4 and 5 According to the present invention, there is provided a method of forming a bed to match a user including the steps of a) Determining a plurality of essential positions along the profile of the user;

b) Determining required support needs at the essential positions of the profile of the user; and c) Forming a bed with differing support characteristics along the length of the bed wherein the matching of the bed to the user matches the required support needs of the user at the essential positions of the profile of the user.

Preferably the differing support characteristics matching required support needs includes one or more of:

a) Depression, being positive or negative depression, to allow varying width of 15 portion of user body at essential positions along the profile of the user;

b) Support to support the portion of user body at essential positions along the profile of the user; and c) Pressure attenuation to vary the pressure on the width of portion of user body at essential positions along the profile of the user to match:

i) The weight at the width of portion of user body at essential positions along the profile of the user; or ii) The cushioning contact need at the width of portion of user body at essential positions along the profile of the user.

The essential positions of the profile of the user can include at least one or more of Shoulder area, Lumbar area and Hip area.

The forming of the bed with differing support characteristics along the length of the bed can include the steps of:

a) Using the measured essential positions along the profile of the user, create corresponding essential positions along the length of a bed matching the longitudinal spacing along the profile of the user;

b) Using the detected required support needs at the essential positions and creating 5 the bed at the corresponding positions matching along the user profile;

c) Completing the formation of the bed along its length.

In order to provide optimal support a bed mattress should be able to react independently to the different regions of the users body and at least able to provide dedicated support for the upper, middle and lower torso regions, which all have quite distinct weight distribution and support requirements.

An analysis of these three regions designated Region "C" for upper torso; Region "B" for middle torso; and Region "P" for lower torso, highlights the different requirements needed to provide optimal support.

Given that the weight of the lower torso (pelvis region "P") Wp is about 130% 15 of the weight of the middle torso (Belly region "B") Wb; and the weight of the upper torso (chest region "C") We is about 50% of the weight of Wb. Then Wb=Wp/I. 3=0.77 Wp Wc=0.5Wb=0.39 Wp If the mattress deflection at region B is minimal-say 15 mm and the lumbar curve of a user's spine is about 60 mm then for a mattress of uniform stiffness or 20 elasticity, deflection at region P and region C should be about 15+60 mm=75 mm. Such a deflection will require a spring stiffness Kb of (75/15)×[(1.0/1.3)×Kp]=385% Kp The spring stiffness Kc at region C should be (0.5/1.3)×Kp=39% Kp In summary, in order to provide optimal support over the region C, B and P the following general variation in firmness of the support material would be desirable.

| Upper Torso Kc | Middle Torso Kb | Lower Torso Kp |
|---|---|---|
| 0.4 Kp | 3.8 Kp | Kp |
| Kc | 9.5 Kc | 2.5 Kc |
| 0.1 Kb | Kb | 0.26 Kb |

Such variation in firmness of the support material is not usually available in production mattresses. The high cost of producing a mattress with such degrees of variation in stiffness plus the differing height of the end user necessitating different placement of regions C, B and P has prohibited the manufacture and availability of mattresses with such performance characteristics to date.

In order to provide a mattress or bed base or combination, which can be considered as a 'whole body support structure' in one embodiment, it is necessary to calculate the requirements it needs to fulfill in order to minimize distortion of the body being supported. There are three main areas that have very different and specific needs:

a) a first corresponding with the waist and lumbar, b) a second corresponding with the hip, and c) a third corresponding with the shoulders.

If we virtually consider the body as transverse slices from head to toe, if we define that:

i) The weight of a transverse slice "n" is Pn ii) The depression of the mattress for natural alignment of transverse slice "n" is Dn iii) The width differential of the hips to the waist is "L"

iv) The width differential of the shoulder to the hips is "S"

v) The embedment/insertion of the body at the waist (or narrowest part of the torso) is "I"

vi) The firmness of spring or support material at point "n" is Kn

Then $$Pn=Kn*Dn \text{ and } Dn=Pn/Kn$$

Further if we define that:

a) the depression of the mattress at the waist/lumbar as Dw, the weight of a unit area at that part of the body as Pw, b) the depression of the mattress at the shoulders as Ds, the weight of a unit area at that part of the body as Ps, c) the depression of the mattress at the hips Dh, the weight of a unit area at that part of the body as Ph, d) the stiffness/supportive ability of the mattress of a unit area at that part of the body as Ks (shoulder), Kw (waist/lumbar), and Kh (hips).

e) and that

At the waist $Dw=I\ Kw=Pw/I$

At the hip $Dh=I+L\ Kh=Ph/I+L$

At the shoulder $Ds=I+L+S\ Ks=Ps/I+L+S$

Then $$Ks=Kh(Ps/Ph)*\{(I+L)/I+L+S)\}$$

$$Kw=Kh*(Pw/Ph)*\{(I+L)/I)\}.$$

And at point "*n*" along the torso $Kn=Wn/I+Ln+Sn$

Calculations have been carried out for such range of values as:

a) L or lumbar curve=20, 35, 50, 65)

b) Pw the weight/unit area at the Waist as being Double the weight that at the Shoulders and =(2*Ps), and the weight per unit area at the hips Ph as 2.5 times that at 15 the shoulders=(2.5*Ps)

c) The depression on the bed at the waist/lumbar: Dw as 1 to 30 mm, (calculate for Dw=to 1, 5, 10, 20, 30) 20 ix) the shoulders to be wider than the hips by S which can be from 0 to 100 mm (calculate for S=to 0, 25, 50, 75, 100) x) it should be noted that for stomach sleepers, L refers to the vertical difference between the compressed stomach and upper thighs, and S as the vertical difference between the compressed stomach and the outer part of the body (usually the chest).

Since the depression Dn of the bed at a point 'n' is given by the equation Dn=Pn/Kn, conversely: Kn=Pn/Dn (Where Pn is the weight supported by the bed at point 'n' and Kn is the effective firmness of the bed at point 'n')

Also it is important to note that if the bed comprises a mattress and a base then the equation Dn=Wn/Kn becomes Dn=Wn/Kn of mattress material+Kn of Base material)

Tabulating values for these different combinations gives a picture of the values and inter-relationship between these factors.

For a MALE, one not-so-extreme situation would be:

a) Weight at stomach approx.=2*that at shoulders, Weight at hips and upper thighs approx.=to weight at stomach so Pw=2*Ps, Ph=Pw=2*Ps b) A Lumbar curve or hips wider than waist of say: 35 mm and shoulders wider than hips 75 mm c) TOTAL VARATION 110 mm. This body shape is very common with athletes and tradesmen.

Figure 6:
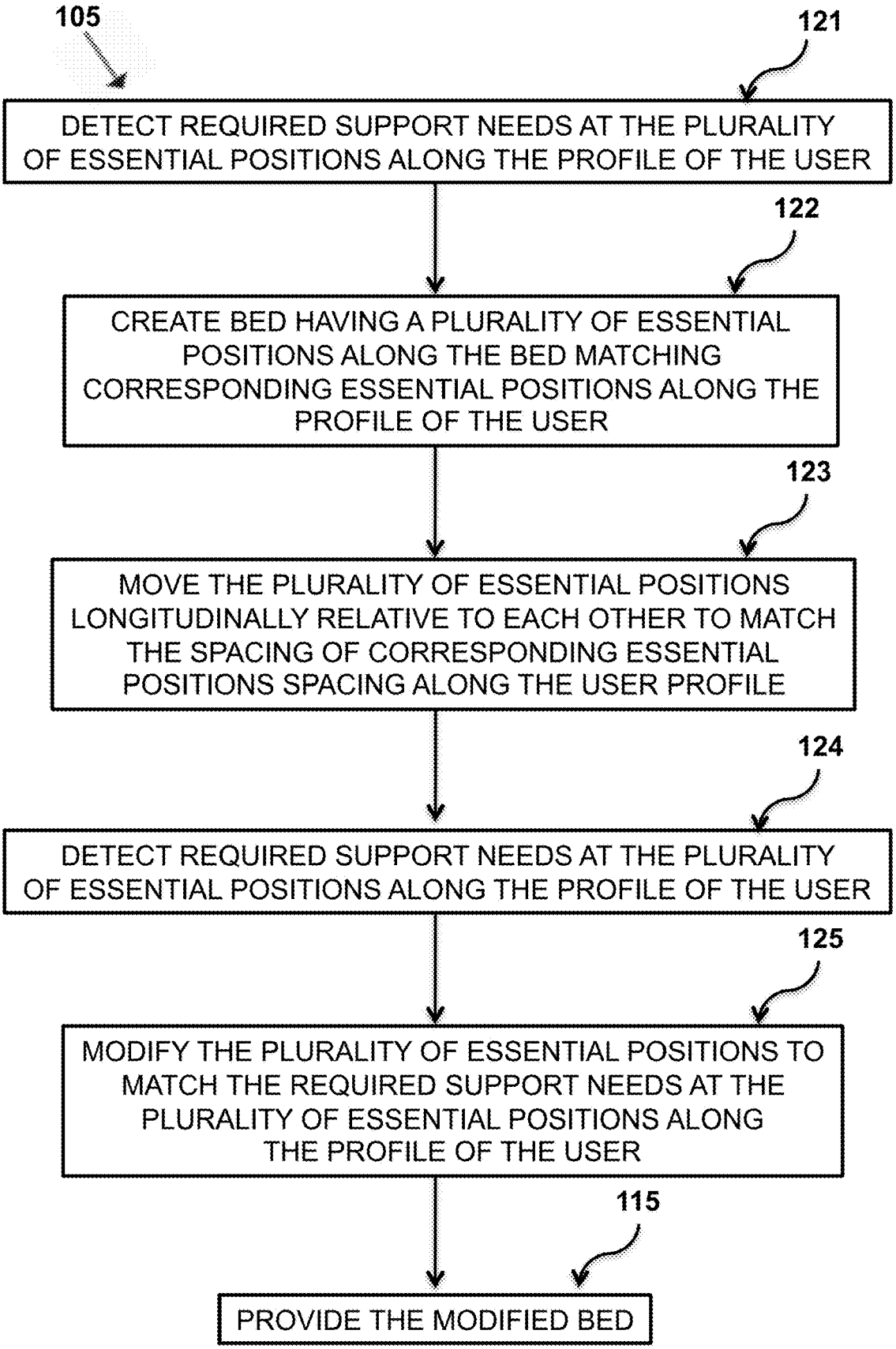
FIG. 6 is a diagrammatic flow diagram of the steps of forming the bed from a pre-formed structure modified to the determined characteristics of the user in accordance with a preferred embodiment of the present invention.
Figure 7:
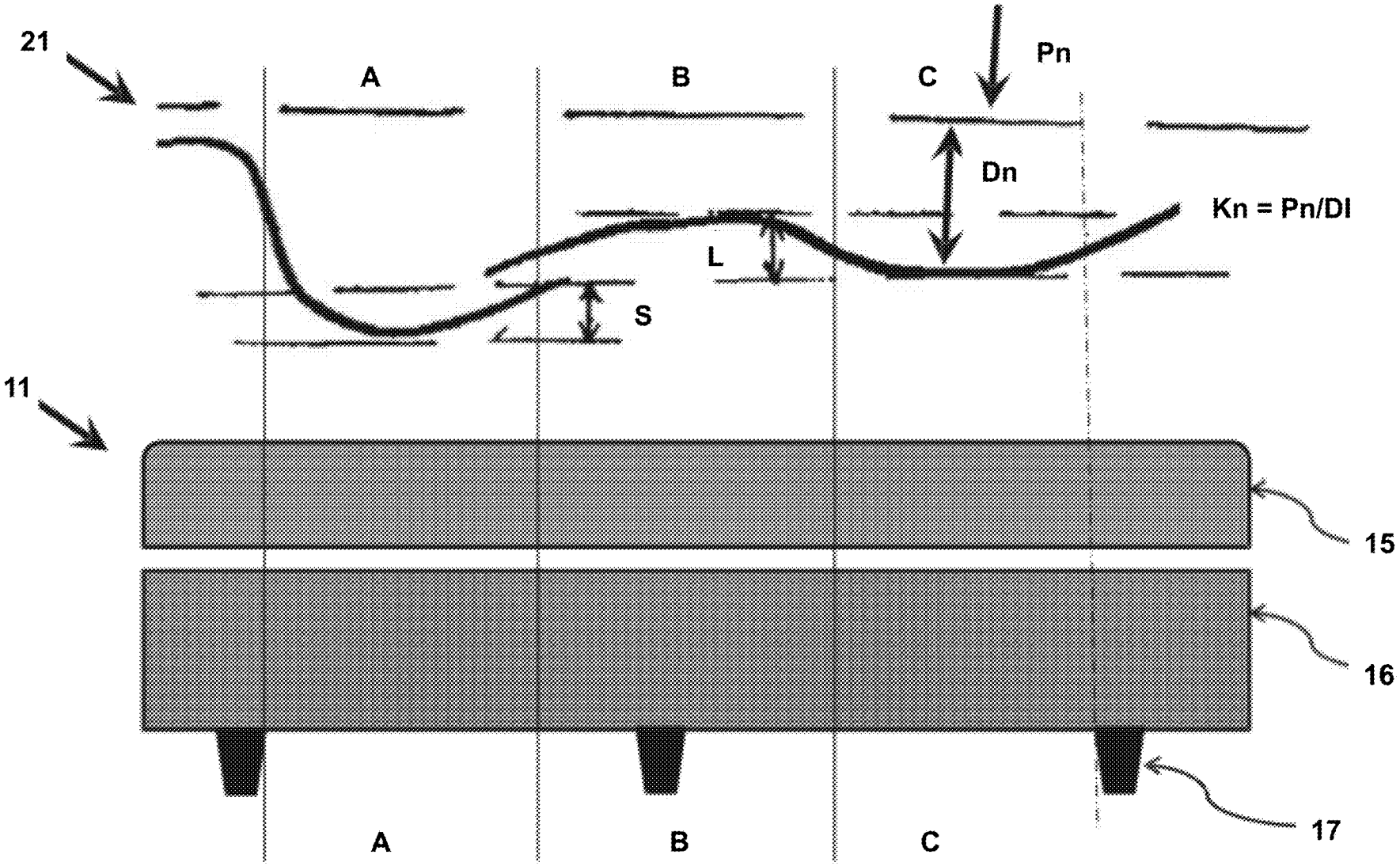
FIG. 7 is an diagrammatic side view of an improved bed having a mattress and a base in accordance with a preferred embodiment of the present invention.
Figure 8:
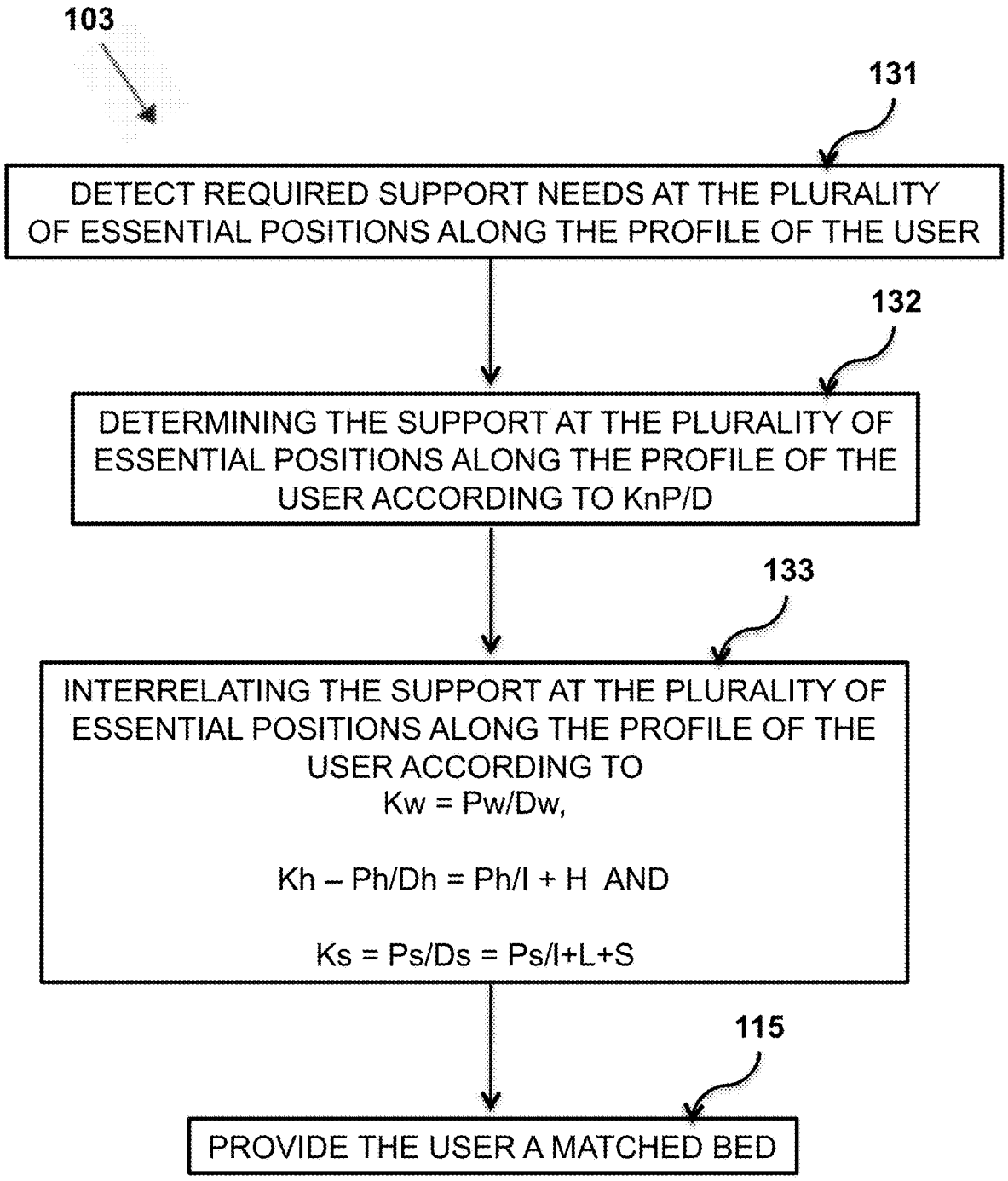
FIG. 8 is a diagrammatic flow diagram of the steps of detecting and determining the determined characteristics of the user so as to form the bed in accordance with a preferred embodiment of the present invention.
Figure 9:
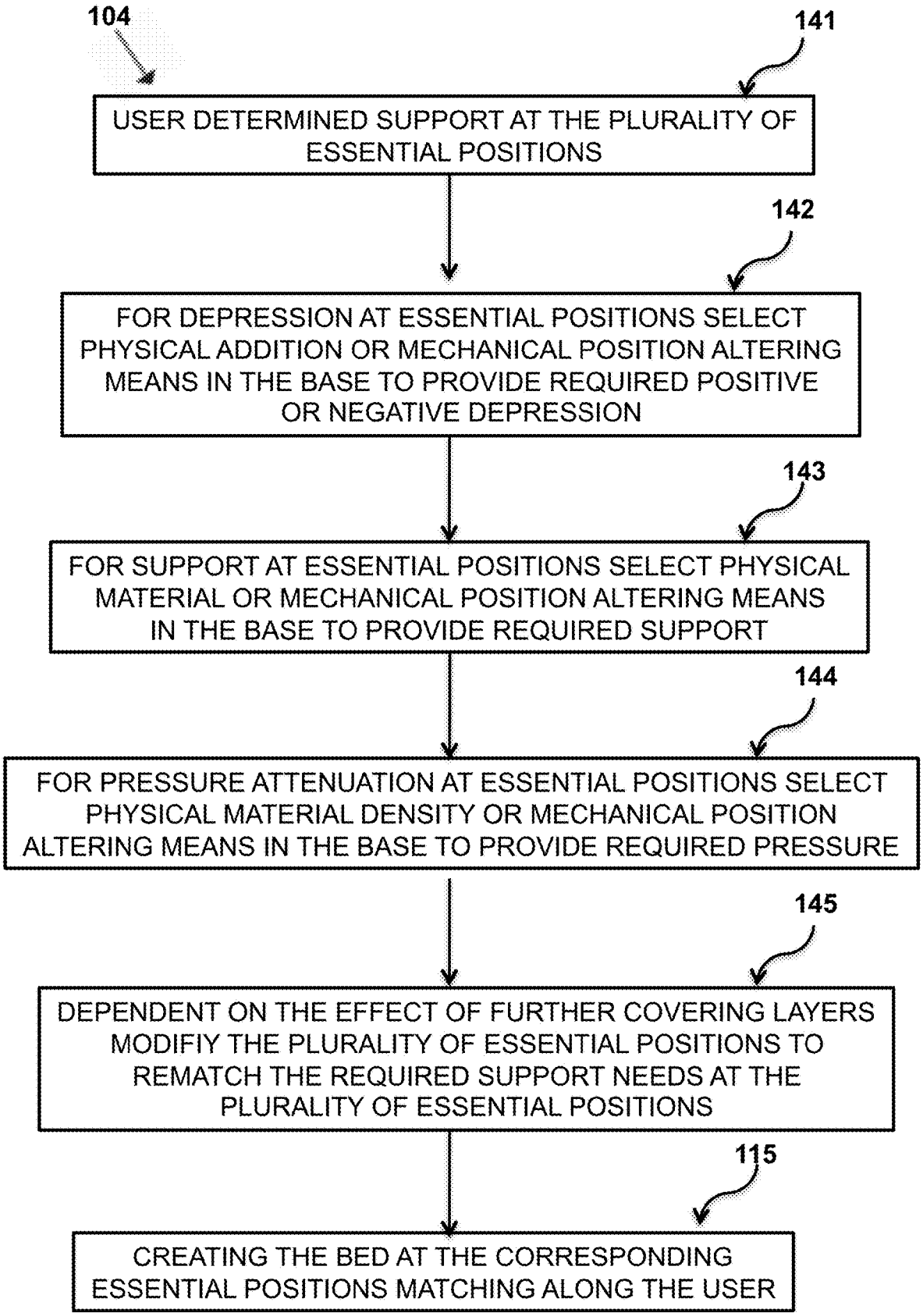
FIG. 9 is a diagrammatic flow diagram of the steps of determining the differing support characteristics needed to match the determined characteristics of the user so as to form the bed in accordance with a preferred embodiment of the present invention.

For a FEMALE, one not-so-extreme situation would be:

a) Weight at stomach approx.=2.0*that at shoulders, b) Weight at hips and upper thighs approx. 15% extra to weight at stomach so Pw=2*Ps, AND Ph=1.15*Pw=2.3*Ps c) A Lumbar curve or hips wider than waist of say: 65 mm and shoulders wider than hips −15 mm d) TOTAL VARATION 50 mm d) Designing of the Bed from a Pre-Formed Referring to FIG. 6 in another form the method of forming a bed to match a user can include the step of pre-forming of the bed with differing support characteristics along the length of the bed includes the steps of:

a) Providing a general structure of a bed having a plurality of essential positions along the bed;

b) Using the measured essential positions along the profile of the user, moving longitudinally corresponding essential positions along the length of a bed to match the longitudinal spacing along the profile of the user; and c) Using the detected required support needs at the essential positions modifying the plurality of essential positions to match the required support at the corresponding positions matching along the user profile.

3 examples of how to shape the bed for each (male and female) on their own or on each respective side of the bed if they were a couple:

We have the various equations:

$Kn=Pn/Dn$ which means that 'at point $n$', the Depression=the weight of the body at point n/firmness of the mattress at point n Specifically, at the waist, shoulders and hips—

$Kw=Pw/Dw,$ $Kh=Ph/Dh=Ph/I+H$ $Ks=Ps/Ds=Ps/I+L+S$

As described before, the values for Ks, Kw, Kh, can range for a) Indentation into mattress I=1, 20, 40 1<I<40 b) Hip protrusion past waist H=40, 60, 75 1<L<75 c) Shoulder protrusion past hip S=−30, 0, 25, 50, 75, 100−30<S<45

The equations become a little more complex when 'Body Alignment' is arrived at by i)—varying the firmness within and along the mattress (head to toe) and by ii)—varying the surface profile of the base/mattress support This is shown in the following tables and examples and particularly Example 3.

It should be noted that the equations for firmness at a point "n" or waist, hip and shoulder are where the stiffness of the BED as a whole is Kn. It should be understood though that $Kn$ total=$Kn$ base+$Kn$ mattress which affects the way the calculations are done in Examples 1, 2 and 3

Kn is a function of the properties of the material or combination of materials used at that point to provide the required support required at that point. i.e. K of soft foam is low. K is therefore a constant and a Kn can be determined for particular materials, thickness of materials, combination of materials and form a particular Kn that is a constant for that particular material or combination of materials. Therefore when needing a Kn it is possible to know which material or combination of materials will provide that Kn and use it at the required location.

TABLE 1

| for Depression/embedment at the waist of: | | | | | | | | | | | | | | | | | | | |
|---|---|---|---|---|---|---|---|---|---|---|---|---|---|---|---|---|---|---|---|
| Dw = 1 mm | | | | 5 mm | | | | 10 mm | | | | 20 mm | | | | 30 mm | | | |
| 'L' | Ks | Kw | Kh | 'L' | Ks | Kw | Kh | 'L' | Ks | Kw | Kh | 'L' | Ks | Kw | Kh | 'L' | Ks | Kw | Kh |
| Shoulder wider than waist by: | | | | | | | | | | | | | | | | | | | |
| S = 0 mm | | | | | | | | | | | | | | | | | | | |
| 20 | 0.4 | 16.8 | 1 | 20 | 0.4 | 4 | 1 | 20 | 0.4 | 2.4 | 1 | 20 | 0.4 | 1.6 | 1 | 20 | 0.4 | 1.3 | 1 |
| 35 | 0.4 | 28.8 | 1 | 35 | 0.4 | 6.4 | 1 | 35 | 0.4 | 3.6 | 1 | 35 | 0.4 | 2.2 | 1 | 35 | 0.4 | 1.7 | 1 |
| 50 | 0.4 | 40.8 | 1 | 50 | 0.4 | 8.8 | 1 | 50 | 0.4 | 4.8 | 1 | 50 | 0.4 | 2.8 | 1 | 50 | 0.4 | 2.1 | 1 |
| 65 | 0.4 | 52.8 | 1 | 65 | 0.4 | 11 | 1 | 65 | 0.4 | 6 | 1 | 65 | 0.4 | 3.4 | 1 | 65 | 0.4 | 2.5 | 1 |
| S = 25 mm | | | | | | | | | | | | | | | | | | | |
| 20 | 0.18 | 16.8 | 1 | 20 | 0.2 | 4 | 1 | 20 | 0.2 | 2.4 | 1 | 20 | 0.2 | 1.6 | 1 | 20 | 0.4 | 1.3 | 1 |
| 35 | 0.24 | 28.8 | 1 | 35 | 0.3 | 6.4 | 1 | 35 | 0.3 | 3.6 | 1 | 35 | 0.2 | 2.2 | 1 | 35 | 0.4 | 1.7 | 1 |
| 50 | 0.27 | 40.8 | 1 | 50 | 0.3 | 8.8 | 1 | 50 | 0.3 | 4.8 | 1 | 50 | 0.3 | 2.8 | 1 | 50 | 0.4 | 2.1 | 1 |
| 65 | 0.29 | 52.8 | 1 | 65 | 0.3 | 11 | 1 | 65 | 0.3 | 6 | 1 | 65 | 0.3 | 3.4 | 1 | 65 | 0.4 | 2.5 | 1 |
| S = 60 mm | | | | | | | | | | | | | | | | | | | |
| 20 | 0.12 | 16.8 | 1 | 20 | 0.2 | 4 | 1 | 20 | 0.2 | 2.4 | 1 | 20 | 0.2 | 1.6 | 1 | 20 | 0.2 | 1.3 | 1 |
| 35 | 0.17 | 28.8 | 1 | 35 | 0.2 | 6.4 | 1 | 35 | 0.2 | 3.6 | 1 | 35 | 0.2 | 2.2 | 1 | 35 | 0.2 | 1.7 | 1 |

TABLE 2

| for Depression/embedment at the waist of: | | | | | | | | | | | | | | | | | | | |
|---|---|---|---|---|---|---|---|---|---|---|---|---|---|---|---|---|---|---|---|
| Dw = 1 mm | | | | 5 mm | | | | 10 mm | | | | 20 mm | | | | 30 mm | | | |
| 'L' | Ks | Kw | Kh | 'L' | Ks | Kw | Kh | 'L' | Ks | Kw | Kh | 'L' | Ks | Kw | Kh | 'L' | Ks | Kw | Kh |
| S = 75 mm | | | | | | | | | | | | | | | | | | | |
| 20 | 0.09 | 16.8 | 1 | 20 | 0.1 | 4 | 1 | 20 | 0.1 | 2.4 | 1 | 20 | 0.1 | 1.6 | 1 | 20 | 0.1 | 1.3 | 1 |
| 35 | 0.13 | 28.8 | 1 | 35 | 0.2 | 6.4 | 1 | 35 | 0.2 | 3.6 | 1 | 35 | 0.1 | 2.2 | 1 | 35 | 0.1 | 1.7 | 1 |

TABLE 2-continued

| for Depression/embedment at the waist of: | | | | | | | | | | | | | | | | | | | |
|---|---|---|---|---|---|---|---|---|---|---|---|---|---|---|---|---|---|---|---|
| Dw = 1 mm | | | | 5 mm | | | | 10 mm | | | | 20 mm | | | | 30 mm | | | |
| 'L' | Ks | Kw | Kh | 'L' | Ks | Kw | Kh | 'L' | Ks | Kw | Kh | 'L' | Ks | Kw | Kh | 'L' | Ks | Kw | Kh |
| 50 | 0.16 | 40.8 | 1 | 50 | 0.2 | 8.8 | 1 | 50 | 0.2 | 4.8 | 1 | 50 | 0.2 | 2.8 | 1 | 50 | 0.2 | 2.1 | 1 |
| 65 | 0.19 | 52.8 | 1 | 65 | 0.2 | 11 | 1 | 65 | 0.2 | 6 | 1 | 65 | 0.2 | 3.4 | 1 | 65 | 0.2 | 2.5 | 1 |
| S = 100 mm | | | | | | | | | | | | | | | | | | | |
| 20 | 0.07 | 16.8 | 1 | 20 | 0.1 | 4 | 1 | 20 | 0.1 | 2.4 | 1 | 20 | 0.1 | 1.6 | 1 | 20 | 0.1 | 1.3 | 1 |
| 35 | 0.11 | 28.8 | 1 | 35 | 0.1 | 6.4 | 1 | 35 | 0.1 | 3.6 | 1 | 35 | 0.1 | 2.2 | 1 | 35 | 0.1 | 1.7 | 1 |
| 50 | 0.14 | 40.8 | 1 | 50 | 0.1 | 8.8 | 1 | 50 | 0.1 | 4.8 | 1 | 50 | 0.1 | 2.8 | 1 | 50 | 0.1 | 2.1 | 1 |
| 65 | 0.16 | 52.8 | 1 | 65 | 0.2 | 11 | 1 | 65 | 0.2 | 6 | 1 | 85 | 0.2 | 3.4 | 1 | 65 | 0.2 | 2.5 | 1 |

Example Bed 1. (Corrective Shaping is Affected Fully within the Mattress)

The mattress for each is made with a hybrid of varying firmness along the bed such that the depression at the 3 key points are appropriate for each.

i) for the male, for a mattress on which the Dw (depression at waist)=20 mm, $$Ks,m=Kh\times(20+35)/(20+35+75)\times½=0.21*Kh,m \text{ and} \quad (1)$$

$$Kw,m=Kh\times(20+35)/20\times1/1=2.75*Kh,m \quad (2)$$

ii) for the female, for a mattress on which the Dw (depression at waist)=20 mm, $$Ks,f=Kh,f\times(20+65)/(20+65-15)\times1/2.3=0.74*Kh,f \quad (1)$$

$$Kw,f=Kh,f\times(20+65)/(20)\times2/2.3=3.70*Kh,f \quad (2)$$

b) The mattress is manufactured with the 3 important zones at theses calculated values and the areas in between are blended to smoothen the curves produced at the shoulders to waist to hips.

Example Bed 2. (Corrective Shaping is Affected Fully from Means Under the Mattress The mattress is entirely of uniform firmness for both the Male and the Female.

a) The Male compresses the mattress by 40 mm at the waist and therefore only 40/2 20=20 mm at the shoulders (Ps=1/2 Pw). The shoulders are now 20 mm above the 25 waist instead of 110 mm below, and compresses the mattress also 40 mm at the Hips 30 (Ph=Pw) which should be 35 mm below the waist,—so the base system (using blocks or some other means) or 'hump and through system' under the bottom surface of the mattress has to correct the vertical displacement the mattress top surface by i) 10 mm lower at the hips, (now −40−10=−50 mm)

ii) 25 mm raised at waist, (now −40+25=−1 5 mm) net compression at waist, and (25+10=35 mm above hips which is correct)

iii) 105 mm lower at the shoulders so they are (−20−105−(−40)+25=−110 mm below waist).

b) The female also happens to compress the mattress at the waist by 40 mm but (because of her weight) only 40/2=20 mm at the shoulders, and 40*1.15=46 mm at the hips.—so the base system (using blocks or some other means) or 'hump and through system' under the bottom surface of the mattress has to correct the vertical displacement the mattress top surface by i) 24 mm raised at the waist (this is now a nett −40+24=−16 mm depression at the waist)

ii) 35 mm lower at the hips (this is now 6+24+35=65 mm below the waist)

iii) 46 mm lower at the shoulders (this is now −20+16−(−40)+24=−50 mm below the waist)

Example Bed 3. (Corrective Shaping is Affected Fully by a Hybrid of Means: from i) within the Mattress, ii) Underneath the Bottom Surface of the Mattress but Above the Top Surface of the Base, and iii) by Shaping of the Top Surface of the Base Means Under the Mattress)

The user can use a full combination of Zoning (shaping) within the mattress and applying the nett applicable corrections by the mattress supportive system.

a) Using a zoned mattress with voids and other predetermined compressible support means such that its properties are—as follows: Dw=20 mm, L=35, Ks=0.2, Kw−2.2, S=25 mm. (for Pw=2Ps and Ph=2.5Ps) Then:

i) The Male compresses the mattress at the waist by 20 mm, L=35*(2/2.5)=28 mm, so hips are 28 mm below the waist and S 25 mm so the shoulders are 25 mm below the 30 waist b) So the—base system (using blocks or some other means) or 'hump and through system' under the bottom surface of the mattress is able to correct the vertical displacement the mattress top surface as follows:

i) place a +ve 25 mm shape (flat in this case) from below the shoulder area to the 5 feet, this means that the shoulders are now −25−25=−50 mm below the waist ii) −ve 7 mm vertical displacement of the hips (−28−7=−35 mm) which aligns the hips correctly with the waist.

iii) −ve 60 mm vertical displacement at the shoulder area so shoulders are aligned, c) The Female compresses the Mattresses at the waist by 20 mm, L=35*(I.15*2/2.5)=32 mm, so hips are 32 mm below the waist and S 25 mm so the shoulders are 25 mm below the waist i) So the base system (using blocks or some other means) or 'hump and through system' under the bottom surface of the mattress has to correct the vertical displacement the mattress top surface by placing a +ve 25 mm shape (flat in this case) 15 from below the shoulder area to the feet, this means that the shoulders are now −25−25=−50 mm below the waist which is correct, depressing the hip area only by the base supportive surface by −ve 33 mm this now makes the hips (−33−32=)−65 mm below the waist.

e) General Shoulder Support Structure

Figure 10:
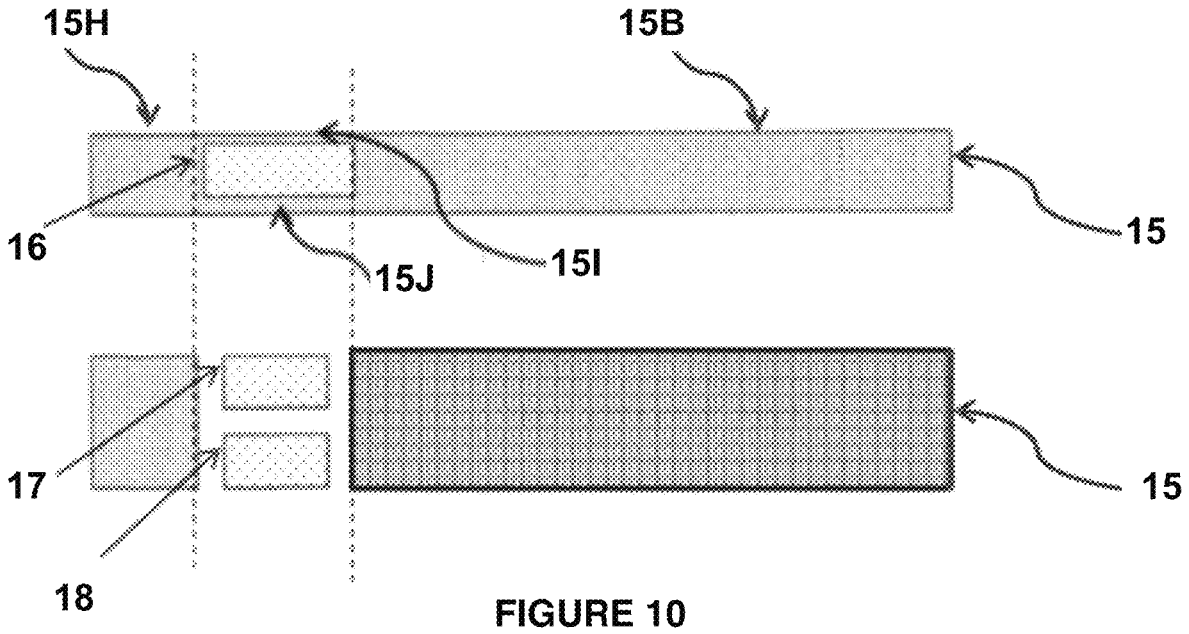
FIGS. 10 and 11 are illustrative longitudinal cross-sectional views of an improved bed in accordance with another preferred embodiment of the present invention with a mattress having a Shoulder Pressure Attenuation Area (SPAAM) locatable at different locations along the longitudinal extension of the bed.
Figure 11:
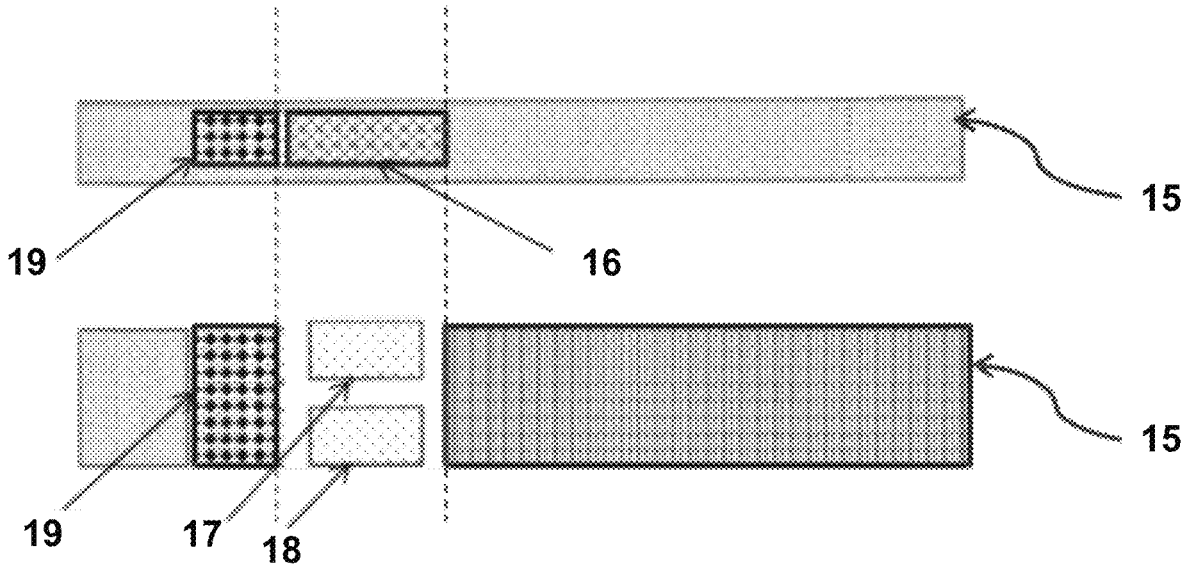

Referring to FIGS. 10 and 11 it can be seen that the invention provides an improved bed which includes a zoned support with a combination of one or more of the following features:

a) a shoulder pressure attenuation area b) a recess or void providing a shoulder pressure attenuation area; and c) a variation of the longitudinal location of the shoulder receiving portion along the bed to suit different users In one form an improved bed includes a shoulder pressure attenuation area 30 SPAAM in order to improve the posture of the user of the bed. This can be my means of a resilient means 16 that is less resilient than the material or structure of the rest of the 32 bed. In this way the shoulder of the user is able to sink into the bed over the shoulder pressure attenuation area SPAAM.

In another form the invention includes an improved bed including shoulder pressure attenuation area SPAAM having a shoulder pressure recess formed by a void 17 or unsupporting material block over a shape retaining block 18 in order to allow receipt of the breadth of the user at the shoulder position improve the posture of the user of the bed.

However the bed is a single element and the mattress has a head portion and a body portion joined together but allowing the shoulder pressure recess or void. The mattress has a head portion and a body portion are joined peripherally. Also, or instead, the mattress has a head portion and a body portion which are joined peripherally along an underside. In both forms the head 15H of the mattress can be connected to the body 15B of the mattress by under joining connection 15J. Further peripheral joins can also be used to provide a continuous circumference to the mattress.

This can be achieved in which an improved bed includes the shoulder support locatable at the shoulder pressure attenuation area by providing a shoulder pressure attenuation in order to improve the posture of the user of the bed. The shoulder pressure attenuation area is in the mattress portion of a base and mattress bed with the shoulder support locatable at the shoulder pressure attenuation area is a shoulder pressure recess or void in order to allow receipt of the breadth of the user at the shoulder position to improve the posture of the user of the bed.

In order to provide a feeling of a solid bed but to provide the benefits of shoulder pressure recess or void the mattress can have a head portion and a body portion joined together by a loose top surface 151 allowing the shoulder of the user to be able to be received in the shoulder pressure recess or void.

Figure 13:
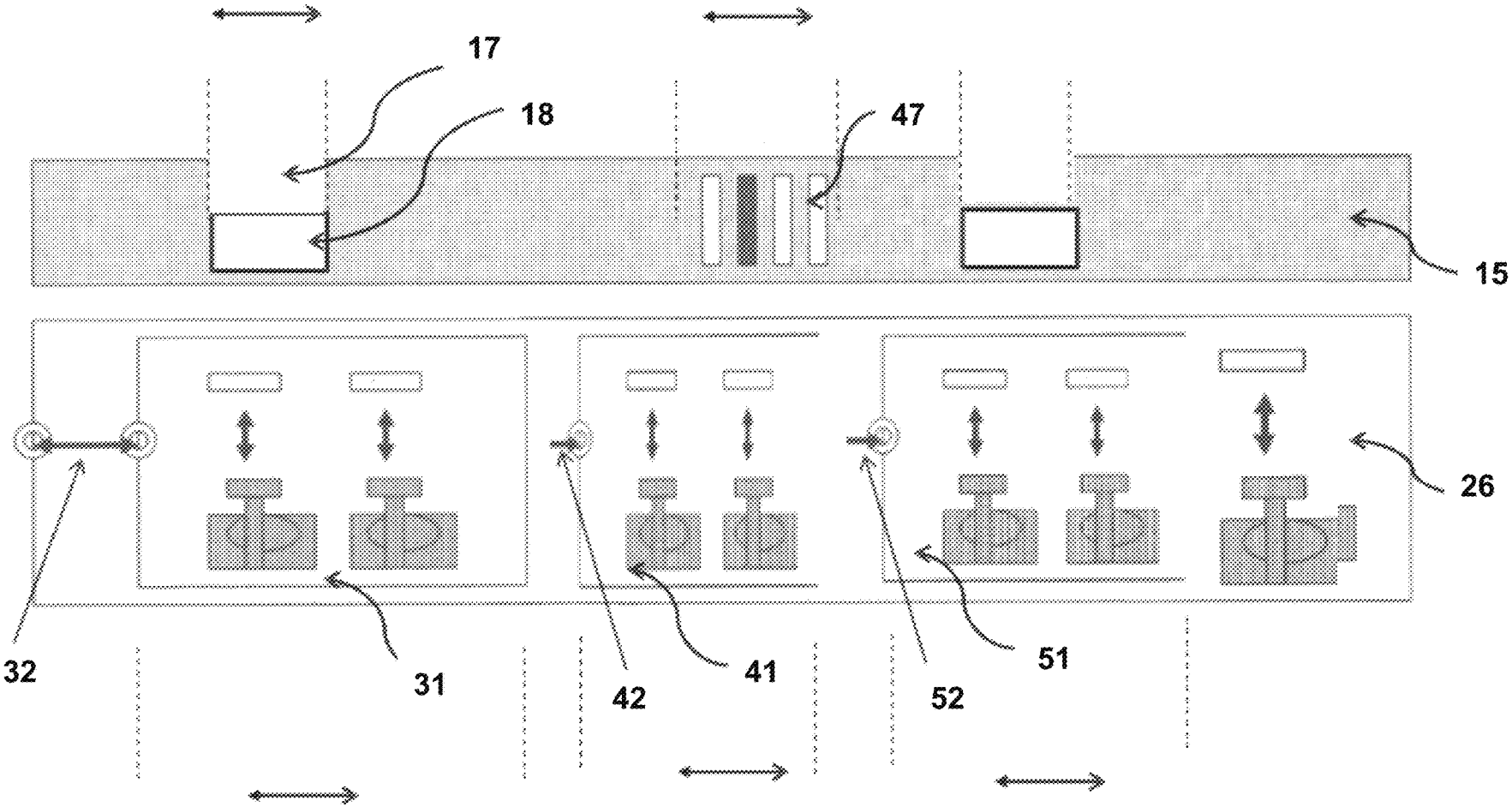
FIG. 13 is an illustrative longitudinal cross-sectional view of an improved bed in accordance with another preferred embodiment of the present invention with i) a mattress having a Shoulder Pressure Attenuation Area (SPAAM) locatable at different locations along the longitudinal extension of the bed and a Lumbar Pressure Attenuation Area (LPAAM) locatable at different locations along the longitudinal extension of the bed and a Hip Pressure Attenuation Area (HPAAM) locatable at different locations along the longitudinal extension of 25 the bed; and ii) a base having a Shoulder Pressure Attenuation Area (SPAAB) locatable at different locations along the longitudinal extension of the bed and a Lumbar Pressure Attenuation Area (LPAAB) locatable at different locations along the longitudinal extension of the bed and a Hip Pressure Attenuation Area (HPAAB) locatable at different locations along the longitudinal extension of the bed.

Referring to FIG. 13 the base 26 of the improved bed includes a shoulder pressure attenuation area SPAAB in order to improve the posture of the user of the bed. This can be my means of a resilient means electric motor driving a cam and raising a platform that can support slats 28 at varying heights. The height at the shoulder level can be lower than at the head or torso level. In this way the shoulder of the user is able to sink into the bed over the shoulder pressure attenuation area SPAAB.

In other forms the base can have cams that are manually driven and instead of slats can have supporting layers within the base that are moved or compressed to provide the shoulder pressure attenuation.

f) Multiple Pressure Attenuation Areas

As well as a shoulder pressure attenuation are SPAA, there can be provided a variation of an improved bed having a plurality of supports locatable at a plurality of pressure attenuation areas in order to improve the posture of the user of the bed. One of the plurality of supports locatable at a plurality of pressure attenuation area can be a lumbar pressure attenuation area LPAA. Another of the plurality of supports locatable at a plurality of pressure attenuation area can be a hip pressure attenuation area HPAA.

The at least one of the plurality of supports locatable at a plurality of pressure attenuation area is adjustable in location. This can be at least one of the plurality of supports locatable at a plurality of pressure attenuation area being adjustable along the length of the bed. However at least one of the plurality of supports locatable at a plurality of pressure attenuation area can be adjustable in a direction substantially orthogonal to the plane of the top surface of the bed which will be substantially vertical in normal use.

However the location of the various pressure variation areas can have a variation of the longitudinal location of the shoulder, hip or lumbar receiving portion along the bed to suit different users.

g) General Longitudinal Variation of Pressure Attenuation Areas

A shoulder pressure variation means 31 can be provided to vary support in a direction to the vertical at a shoulder receiving portion SPAA. However the location of that shoulder pressure variation or shoulder pressure attenuation 31 can have a variation of the longitudinal location of the shoulder receiving portion by allowing a movement to alter position along the bed to suit different users. This can be by fillers 19 allowing manual rearrangement or by automatic means 32.

Figure 12:
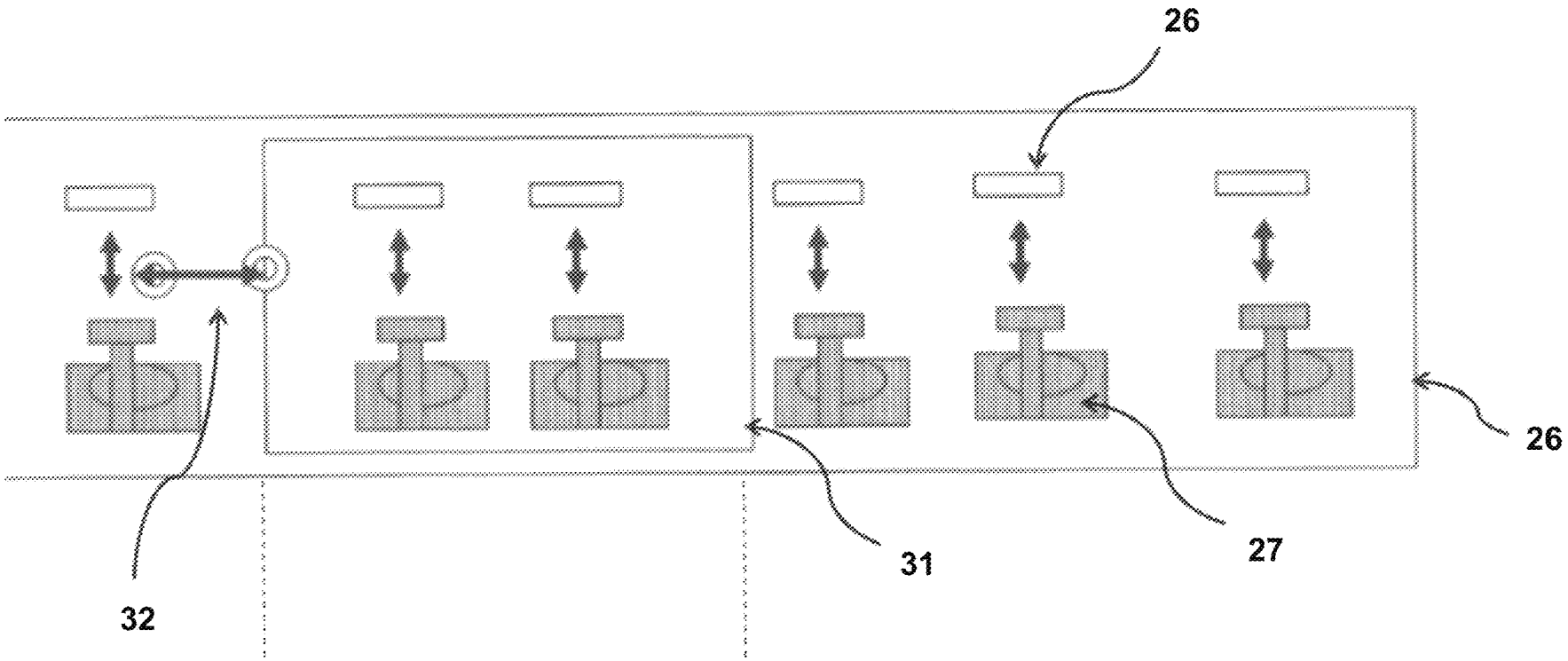
FIG. 12 is an illustrative longitudinal cross-sectional view of an improved bed in accordance with another preferred embodiment of the present invention with a base having a Shoulder Pressure Attenuation Area (SPAAB) locatable at different locations along the longitudinal extension of the bed.

Referring to FIGS. 11 and 12 there is shown a mattress 15 having a Shoulder Pressure Attenuation Area (SPAAM) locatable at different locations along the 34 longitudinal extension of the bed. In FIGS. 2A and 2B there is the use of voids and resilient blocks which can be arranged so as to provide the variability. The shoulder pressure attenuation area SPAAM having the shoulder pressure recess formed by a void 17 or non-supporting material block over a shape retaining block 18 can be moved. Referring to FIG. 2B in a recess there is located a filler block 19 which has resilience similar to the rest of the mattress which then moves the void 17 or non-supporting material block over a shape retaining block 18 further along the longitudinal length of the bed. In this way the position of the shoulder pressure attenuation area SPAAM is moved along the longitudinal direction of the bed order to allow suitable alignment for the particular user at the shoulder position improve the posture of the user of the bed.

Similarly in FIG. 13 there is shown a base 16 of a bed having a Shoulder Pressure Attenuation Area (SPAAB) locatable at different locations along the longitudinal extension of the bed. In FIG. 13 electric motors 27 can drive an arm that supports a slat 28 at various heights. However the plurality of can be located on a carriage 31 and that carriage as a whole can be moved by electric motor 32 in the longitudinal direction.

Figure 14:
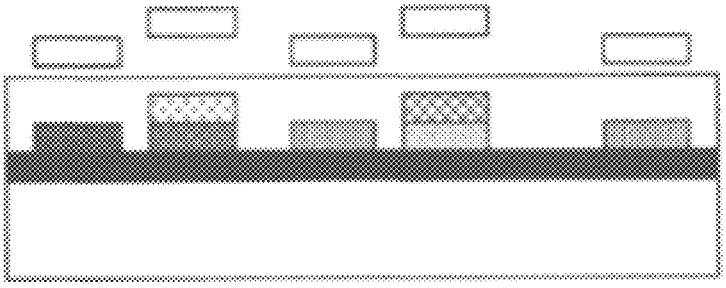
FIGS. 14 and 15 are diagrammatic views of alternative supporting means that can be used at the Shoulder Pressure Attenuation Area (SPAAB) or the Lumbar Pressure Attenuation Area (LPAAB) or the Hip Pressure Attenuation Area (HPAAB)
Figure 15:
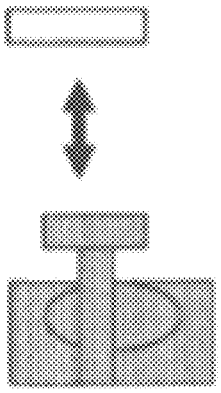

Preferably as shown in FIG. 14 there can be the combination of shoulder support in the mattress and in the base. This can be achieved in which there an improved bed is comprising a shoulder support locatable at a shoulder pressure 20 attenuation area providing a shoulder pressure attenuation in order to improve the posture of the user of the bed. Portions of the shoulder support are located in shoulder pressure attenuation areas (SPAAM, SPAAB) in the mattress of a bed and in a base of the bed and wherein the shoulder pressure attenuation areas (SPAAM, SPAAB) in both the base and the mattress of the bed being separately alignable to each other and separately including shoulder supports but coordinating to provide a combined shoulder pressure attenuation area.

There is also included a shoulder pressure variation location means 32 for providing a variation along the bed to suit different users of the location of the shoulder pressure attenuation area (SPAAM, SPAAB) in the mattress or the base of the bed. Parts of a shoulder pressure variation location means 32 are located in the base and/or the mattress of the base and mattress of the bed and wherein the mattress shoulder pressure variation location means and the base shoulder pressure variation location means being separately movable longitudinally along the bed relative to each other but coordinating to provide location of the combined shoulder pressure attenuation area to suit different users.

Similar arrangement can occur for the lumbar pressure attenuation areas 5 (LPAAM, LPAAB) of the mattress and the base. A lumbar pressure variation means 41 can be provided to vary support in a direction to the vertical at a shoulder receiving portion SPAA. However the location of that lumbar pressure variation or lumbar pressure attenuation 41 can have a variation of the longitudinal location of the lumbar receiving portion by allowing a movement to alter position along the bed to suit different 10 users. This can be by fillers allowing manual rearrangement or by automatic means 42.

Also similar arrangement can occur for the hip pressure attenuation areas (HPAAM, HPAAB) of the mattress and the base. However the location of that hip pressure variation or hip pressure attenuation 51 can have a variation of the longitudinal location of the hip receiving portion by allowing a movement to alter position along the 15 bed to suit different users. This can be by fillers allowing manual rearrangement or by automatic means 52.

The adjustability of the shoulder pressure attenuation area (SPAAM) in the mattress can be achieved by an improved bed wherein the mattress having a head portion 15H and a body portion 15B joined together with adjacent movable blocks 16, 20 17, 18 and 19 allowing for variable location of the shoulder pressure recess or void along the longitudinal length of the bed.

The adjustability of the shoulder pressure attenuation area (SPAAB) in the base can be achieved by mounting of the shoulder supports 27, 28 along a longitudinal support track and with movable means allowing for variable location of the shoulder pressure attenuation area along the longitudinal length of the bed. The movable means can be manual, ratchet means or electric drives. Preferably a plurality of support means forming the shoulder support are locatable on a carriage 31 and the carriage is movable In this way the plurality of support means together provide the vertical adjustment of support to provide the single support shape and the carriage is moved as a whole to thereby move the supporting shape as a whole along the longitudinal direction of the bed.

It must be understood that the longitudinal adjustability of the location of the shoulder pressure attenuation area or the lumbar pressure attenuation area is not the same as merely differing the heights of differing vertically adjusting supporting means along the length of the bed.

In particular in supporting the posture correctly as shown in FIG. 1 there is a particular relative vertical support provided by either differing heights of support or by differing densities of supporting material or a combination thereof. This in effect provides a supporting shape. This supporting shape is generally formed by support elements that are discrete sizes and could be of the order of 30 millimetres or more.

Three or more of these support elements could be needed along the longitudinal length of the bed to form the supporting shape. Therefore this full support of the shoulder could be 120 millimetres or more. Clearly the adjustability by merely the differences in the in the posture of a person 30 millimetres is a substantial difference and does not provide adequate variation. Moving to smaller support elements is impractical but even if you do results in a very complex alignment to define the shape.

Theoretically if you had 5 millimetres support elements you would have to adjust 24 elements to obtain the 120 millimetres supporting shape. To move such shape along a bed would require adjustment of all 24 supporting elements plus others at either end plus others laterally across the bed. Overall, this is unacceptable as it requires a complex control means, is extremely expensive for so many support elements and substantially increases failure rate due to the multitude of elements.

The present invention solves the adjustment requirement without these disadvantages. In particular there are other substantial benefits to the use of a pressure variation location means including:

i) Firstly you can define your supporting shoulder shape and locate it precisely relative to the shoulder of the user;

ii) Secondly you can define your lumbar support shape and locate it precisely to the lumbar of the user and relative to the supporting shoulder shape iii) The user does not need to conform to the bed but the bed conforms to the user. This is even further emphasized for double, queen and king sized beds usable by couples. The bed can be alterable in separate contiguous longitudinal halves for bed 37 sharing by couples and the shoulder pressure variation location means and the lumbar pressure variation location means allowing for:

(1) particular location of shoulder and lumbar positions of first user;

(2) particular location of shoulder and lumbar positions of second user; and (3) particular relative locations of first and second users. This can be both at head height or one having head height at shoulder height of the other.

Thereby the different heights and supporting profiles of different users are adjustable.

h) Comparison Details

Figure 16:
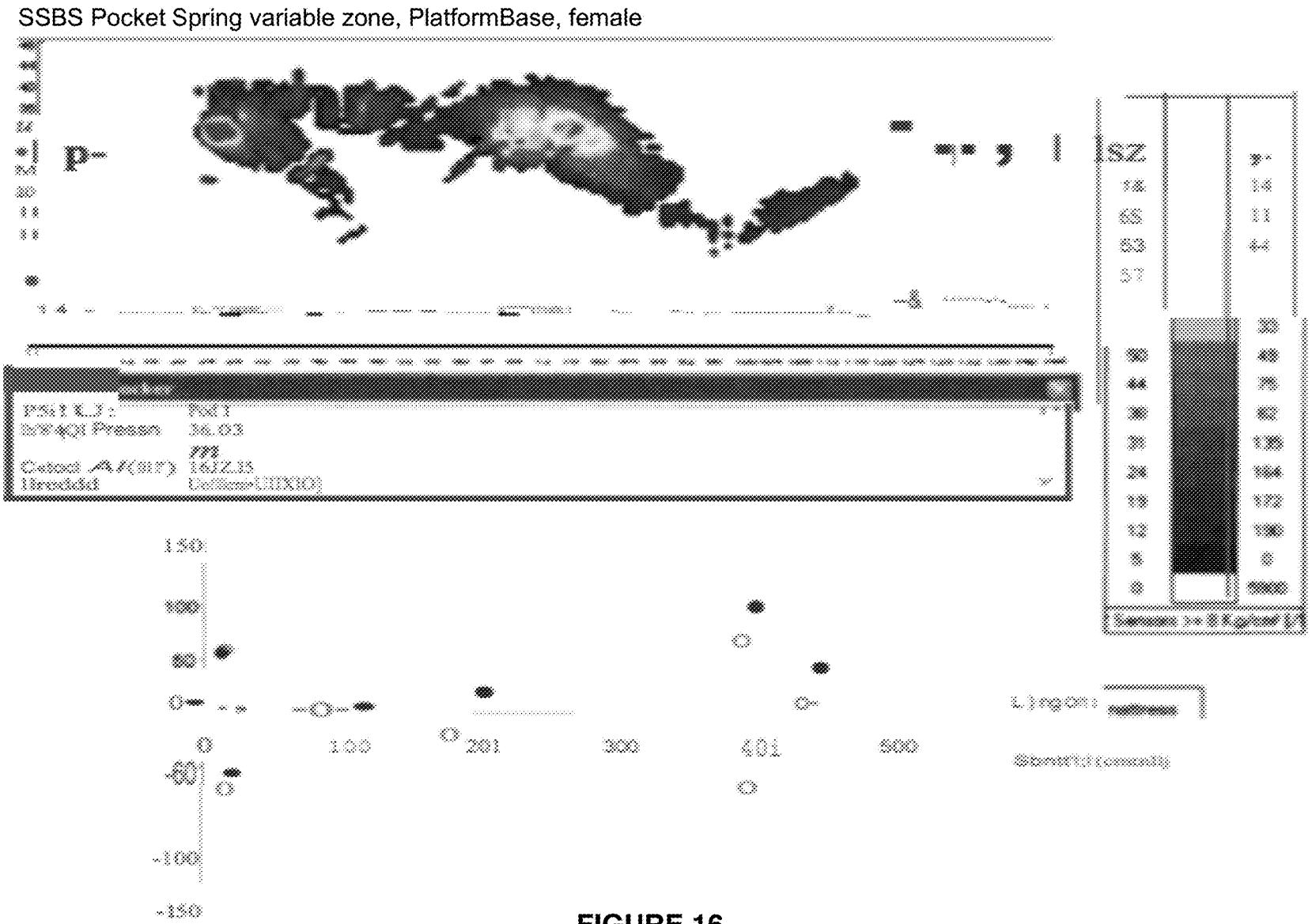
FIGS. 16 and 17 are plot comparisons of pressures recorded of users with or without the bed of the invention.
Figure 17:
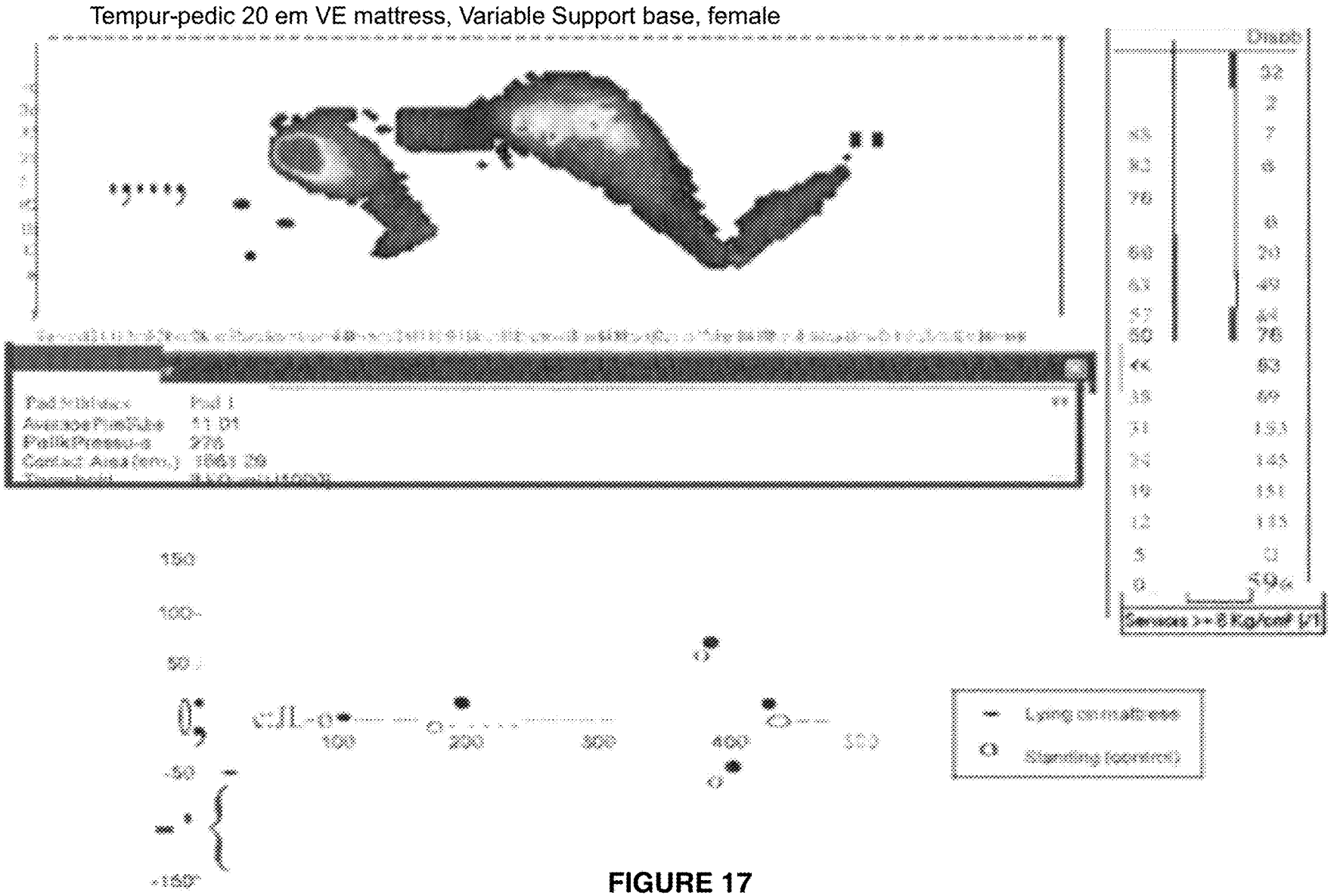

Referring to FIGS. 16 and 17 there is shown a comparative pressure attenuation graph showing the effectiveness of the design.

Figure 18:
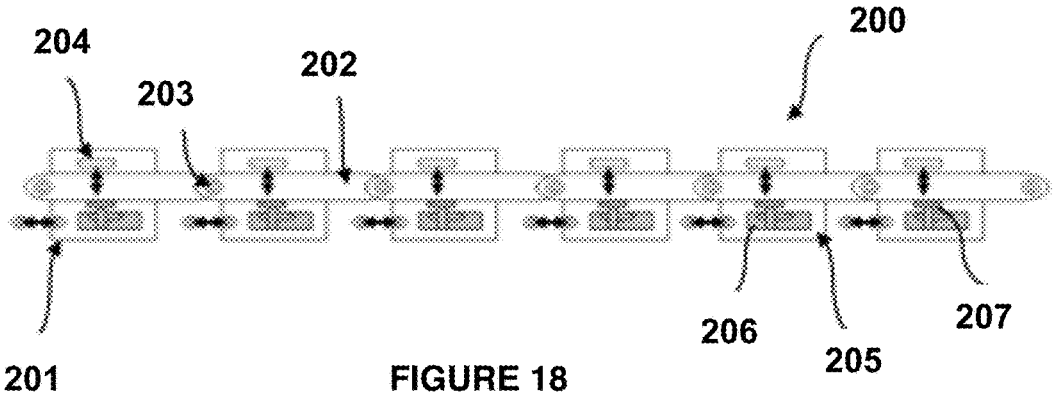
FIGS. 18 to 20 are schematic illustrations from a side view of internals of a base for an improved bed or chair to improve posture of a user in a variety of configurations.
Figure 19:
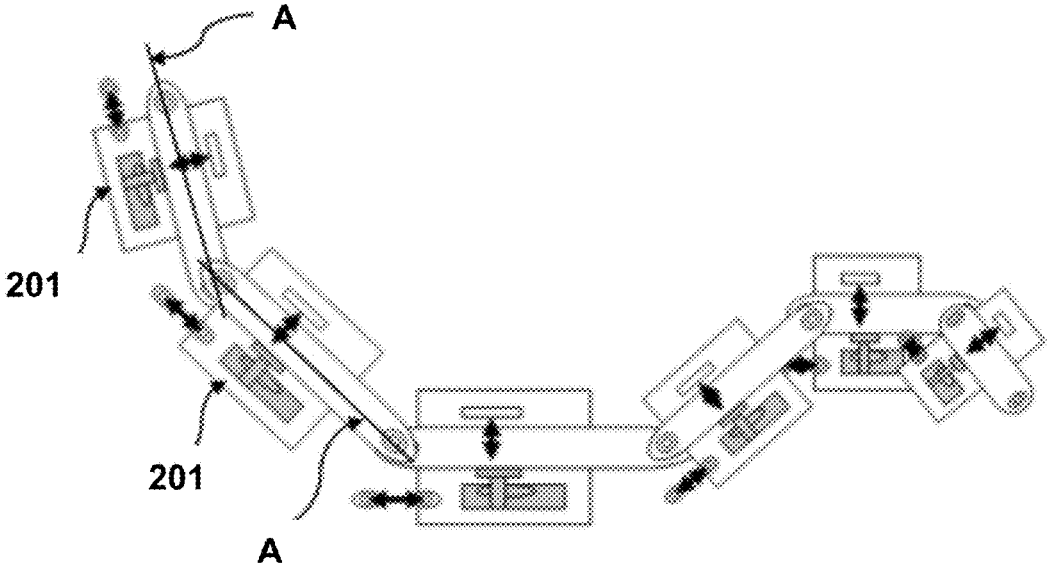
Figure 20:
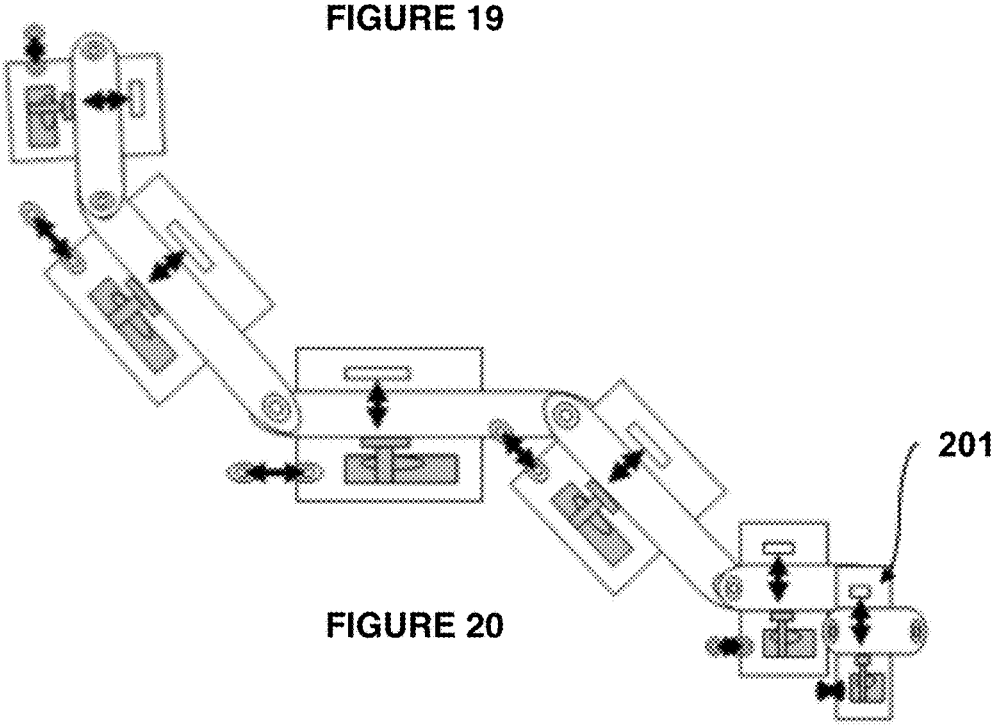

Referring to FIGS. 18 to 20 there is shown an improved base or under-structure 200 for a bed or chair to improve posture of a user when in a range of positions. The base/under-structure comprises a series of pressure variation blocks 201 being located at predetermined shoulder, waist and lumbar pressure attenuation areas providing a shoulder, waist and lumbar attenuation according to the profile of a user.

The pressure variation blocks 201 are linked together by a plurality of knuckles 202 linked at knuckle joints 203 to form a chain. As shown best by lines A and B in FIG. 19, a knuckle joint 203 allows adjustment of one knuckle with respect to its neighbour to change the angle therebetween. In this way the position of the pressure variation blocks and thereby configuration of the base/ under-structure of a bed or chair can be adjusted between a flat position (FIG. 18) to a seated position (FIG. 20) and an inclined position (FIG. 19).

The base/under-structure 200 further includes one or more movable supports 204 in the form of slats mounted on or in the one or more pressure variation blocks 201. The movable supports 204 are raised or lowered vertically by pressure variation location means 205. In FIGS. 18 to 20, the pressure variation location means includes a motor 206 and a piston 207 whereby the motor drives the piston up and down to act on and displace the one or more movable supports 204 on the one or more pressure variation blocks in a vertical direction. In this example, the one or more pressure variation blocks 201 of the base/under-structure 200 of the bed or chair are separately adjustable in the predetermined pressure attenuation areas relative to a mattress/cushions or the like (not shown) to suit different users of the bed or chair.

As shown in FIGS. 19 and 20, the knuckles used to form the chain of pressure variation blocks in the base/under-structure are different lengths. In this way different sized pressure variation blocks can be used to provide a range of different configurations.

Figure 21:
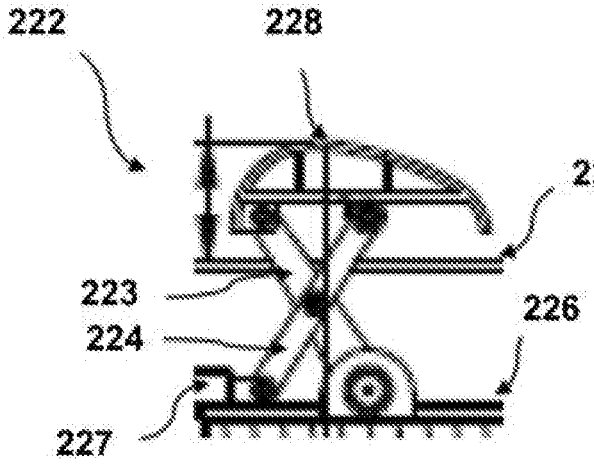
FIGS. 21 to 24 show schematic illustrations of various driving means in side view for raising and lowering supports to achieve predetermined configuration of a base.
Figure 22:
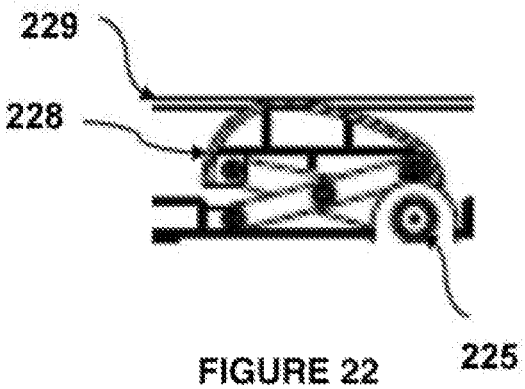

Referring to FIGS. 21 and 22 the pressure variation location means can be a pantograph 222 arrangement located in the one or more pressure variation blocks. As shown the pantograph 222 has two legs 223 and 224 connected by a central pivot joint. Three ends of the legs are fixed and a fourth end 225 is movable along a rail or track 226. A drive means 227 acts against a first fixed leg to drive the pantograph between a folded (FIG. 22) and unfolded (FIG. 21). The pantograph 222 also includes a platform 228 to which two legs are fixed at their ends so that when the legs are displaced by the drive means the platform is raised and lowered vertically thereby displacing support 229.

Figure 23:
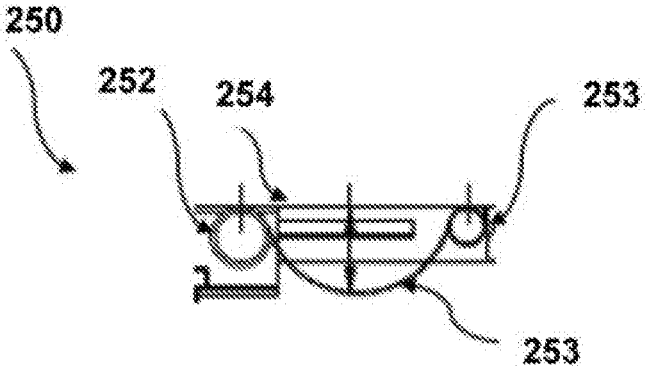
Figure 24:
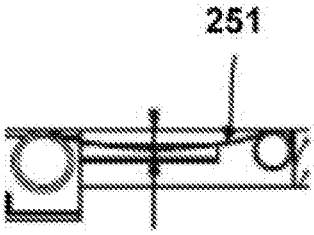

In a further preferred embodiment shown in FIGS. 23 and 24, an alternative pressure variation location means 250 is shown which comprises a sling mounted between rollers 252 and 253 in the pressure variation blocks (not shown). At least one roller is motorised so that the sling can be adjusted to alter configuration between a flat positon (FIG. 24) substantially aligned with a surface 254 of a pressure variation block, and a shallow u-shaped configuration (FIG. 23) providing a negative vertical displacement of the one or more movable supports mounted to the pressure variation blocks. As indicated, the rollers displace the sling between a substantially flat position inwardly of the blocks to provide negative vertical displacement of the one or more movable supports.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Bed

The term Bed is wide ranging and includes single layer beds, mattresses on supports including slats, springs, adjustable beds having mechanical or electric moving parts.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

SCOPE OF INVENTION

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the bedding industries and healthy sleep or patient posture support industries.

The invention claimed is:

1. An improved support structure for a bed or chair comprising an adjustable base or under-structure, comprising:

a. a shoulder support locatable at a shoulder pressure attenuation area providing a shoulder pressure attenuation in order to improve the posture of the user of the support structure, i. wherein portions of the shoulder support are located in shoulder pressure attenuation areas in the base or under-structure of the support structure; and ii. wherein the shoulder pressure attenuation area in the base or under-structure are separately alignable with each other and separately include shoulder supports, and cooperate to provide a combined shoulder pressure attenuation area;

b. a shoulder pressure variation location configured to provide a variation along the support structure to suit different users of the location of the shoulder pressure attenuation area in the base or under-structure of the support structure;

i. wherein parts of a shoulder pressure variation location are located in the base or under-structure of the support structure;

ii. wherein the base or under-structure shoulder pressure variation location are seperately movable longitudinally along the support structure bed relative to each other and cooperate to provide location of the combined shoulder pressure attenuation area to suit different users;

c. one or more pressure variation blocks located at predetermined shoulder, waist and lumbar pressure attenuation areas, configured to provide a shoulder, waist and lumbar attenuation, respectively, according to the profile of a user, wherein the pressure variation blocks are linked together by knuckles at knuckle joints to form a chain, and wherein a knuckle joint allows angular adjustment of one knuckle relative to its neighbor to alter the positioning of the pressure variation blocks;

d. one or more movable supports mounted on the one or more pressure variation blocks;

e. a shoulder pressure variation location means for providing a variation of the one or more movable supports on the one or more pressure variation blocks in a direction to the vertical at a shoulder receiving portion;

f. a waist pressure variation location means for providing a variation of the one or more movable supports on the one or more pressure variation blocks in a direction to the vertical at a waist receiving portion; and g. a lumbar pressure variation location configured to provide a variation of the one or more movable supports on the one or more pressure variation blocks in a direction to the vertical at a lumbar receiving portion, wherein the one or more pressure variation blocks of the base of the support structure are separately adjustable in the predetermined pressure attenuation areas to suit different users of the support structure.

2. The improved support structure for the bed according to claim 1 wherein the shoulder pressure attenuation area is a lower density material to the other bed support parts.

3. The improved support structure for the bed according to claim 1 wherein the shoulder pressure attenuation area has a movable support that can be altered in vertical direction to provide a variation in height of the shoulder pressure attenuation area of a mattress relative to the support of other bed support parts.

4. The improved support structure for the bed according to claim 1 further comprising a shoulder pressure recess in order to allow receipt of the breadth of the user at the shoulder position improve the posture of the user of the bed.

5. The improved support structure for the bed according to claim 1 further comprising a shoulder pressure variation in a direction to the vertical at a shoulder receiving portion and a variation of the location of the shoulder receiving portion along the bed to suit different users.

6. The improved support structure for the bed according to claim 3, wherein the shoulder pressure attenuation area provides variation of the shoulder area in a localized area from the top surface of the mattress, which is easily opened or the topmost layer of which is able to be lifted off, to produce the desired depression (Ds) in a direction to the vertical at a shoulder receiving portion and a variation of the location of the shoulder receiving portion along the bed to suit different users.

7. The improved support structure for the bed according to claim 3, further comprising a shoulder pressure attenuation area providing variation of the shoulder area in a localized area can be varied from the side wall of the mattress to the desired depression (Ds).

8. The improved support structure for the bed according to claim 3, further comprising a shoulder pressure attenuation area providing variation of the shoulder area in a localized area having variation from the side wall of the mattress to the desired depression (Ds).

9. The improved support structure for the bed according to claim 1 further comprising:

a. a lumbar support locatable at a lumbar pressure attenuation area providing a lumbar pressure attenuation in order to improve the posture of the user of the bed, i. wherein portions of the lumbar support are located in lumbar pressure attenuation areas in a mattress of the bed; and ii. wherein a lumbar pressure attenuation area in the mattress of the bed is alignable b. a lumbar pressure variation location means for providing a variation along the bed to suit different users of the location of the lumbar pressure attenuation area in the mattress or the base of the bed;

i. wherein parts of a lumbar pressure variation location means are located in the base and/or the mattress of the base and mattress of the bed; and ii. wherein the mattress lumbar pressure variation location means and the base lumbar pressure variation location means being separately movable longitudinally along the bed relative to each other but coordinating to provide location of the combined lumbar pressure attenuation area to suit different users.

10. An improved support structure for the bed according to claim 1 further comprising:

a. a hip support locatable at a hip pressure attenuation area providing a hip pressure attenuation in order to improve the posture of the user of the bed, i. wherein portions of the hip support are located in hip pressure attenuation areas in a mattress of a bed and/or in a base of the bed; and ii. wherein the hip pressure attenuation area in both the base and the mattress of the bed being separately alignable to each other and separately including hip supports but coordinating to provide a combined hip pressure attenuation area; and b. a hip pressure variation location means for providing a variation along the bed to suit different users of the location of the hip pressure attenuation area in the mattress or the base of the bed, i. wherein parts of a hip pressure variation location means are located in the base and/or the mattress of the base and mattress of the bed; and ii. wherein the mattress hip pressure variation location means and the base hip pressure variation location means being separately movable longitudinally along the bed relative to each other but coordinating to provide location of the combined hip pressure attenuation area to suit different users.

11. The improved support structure for the bed according to claim 1 comprising a lumbar support locatable at a lumbar pressure attenuation area providing lumbar pressure attenuation in order to improve the posture of the user of the bed.

12. The improved support structure for the bed according to claim 1 wherein the lumbar pressure attenuation area is in both the base portion and in a mattress portion of a base and mattress bed.

13. The improved support structure for the bed according to claim 1 further comprising:

a lumbar pressure variation location means for providing a variation of the location of a lumbar receiving portion along the bed to suit different users; and the shoulder pressure variation location means configured to provide a variation of the location of the shoulder receiving portion along the bed to suit different users.

14. The improved support structure for the bed according to claim 1 further comprising:

a lumbar pressure variation in a direction to the vertical at a lumbar supporting portion and a variation of the location of the lumbar supporting portion along the bed to suit different users; and a shoulder pressure variation in a direction to the vertical at a shoulder supporting portion and a variation of the location of the shoulder supporting portion along the bed to suit different users.

15. The improved support structure for the bed according to claim 1 wherein in the case of a shoulder, hip and lumbar pressure attenuation areas, Ks, Kw, Kh, are interrelated, where i. Kw=Pw/Dw, ii. Kh=Ph/Dh=Ph/I+H and iii. Ks=Ps/Ds=Ps/I+L+S and where relative adjustment of the firmness of the support materials vary within a mattress and within the limits set as:

a. positive or negative Indentation I to vary between 1 mm and 50 mm, b. Hips to protrude past waist by L: 1 mm to 70 mm and c. Shoulders to protrude past hips by S: −30 mm (smaller width than hips) to 100 mm.

16. The improved support structure for the bed according to claim 1 further including a mattress or a series of mattresses having a shoulder pressure attenuation area providing variation of the shoulder area in a localised area by one or more of:

a. the shoulder area varies in a localised area from the top surface of the mattress to produce the desired depression (Ds);

b. the shoulder area varies from the top surface of the mattress to produce the desired depression (Ds) and the lumbar area varied from the side wall of the mattress to the desired depression (Dw); and c. the shoulder area varies from the top surface of the mattress to produce the desired depression (Ds), the lumbar area is varied from the sidewall of the mattress to the desired depression (Dw) and the hip area is varied from the sidewall of the mattress to the desired depression (Dh).

17. The improved support structure for the bed according to claim 1, wherein the adjustable base comprises one or more of:

i. a means of causing vertical displacement +ve or −ve under the shoulder, lumbar or hip area by raising or lowering the support member either manually or by powered means or by turning a rod/shaft which in turn turns some cams which lower or raise a supporting member at that area;

ii. a mattress having a means of moving the means that causes vertical displacement at the shoulder, lumbar, hip, and any other area to be moved horizontally towards the head or the feet of the user;

iii. the base has a means of causing vertical displacement +ve or −ve under the lumbar area by raising or lowering the support member using motors or a series of levers at that area;

iv. the base further including a means of moving the means that causes vertical displacement at the lumbar area horizontally towards the head or the feet of the user;

v. a base with a means of causing vertical displacement +ve or −ve under the hip, and any other area of the body and by raising or lowering the support members either manually or by powered means or by turning a rod/shaft which in turn, turns some cams which lower or raise a supporting member at that area;

vi. a means of moving the means that causes vertical displacement horizontally towards the head or the feet of the user;

vii. a further means of causing vertical displacement +ve or −ve under the any other area of the body by either manually or by powered means or by turning a rod/shaft which in turn turns some cams which lower or raise a supporting member at that area; and viii. a means of moving all means that causes +tve or −tve vertical displacement horizontally towards the head or the feet of the user.

* * * * *